US010516959B1

(12) United States Patent
Mindlin et al.

(10) Patent No.: US 10,516,959 B1
(45) Date of Patent: Dec. 24, 2019

(54) METHODS AND SYSTEMS FOR EXTENDED REALITY AUDIO PROCESSING AND RENDERING FOR NEAR-FIELD AND FAR-FIELD AUDIO REPRODUCTION

(71) Applicant: Verizon Patent and Licensing Inc., Arlington, VA (US)

(72) Inventors: Samuel Charles Mindlin, Brooklyn, NY (US); Mohammad Raheel Khalid, Budd Lake, NJ (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 0 days.

(21) Appl. No.: 16/218,473

(22) Filed: Dec. 12, 2018

(51) Int. Cl.

| | |
|---|---|
| ***H04S 5/00*** | (2006.01) |
| ***H04R 3/04*** | (2006.01) |
| ***H04R 5/02*** | (2006.01) |
| ***H04S 7/00*** | (2006.01) |

(52) U.S. Cl.
CPC ..... *H04S 5/005* (2013.01); *H04R 3/04* (2013.01); *H04R 5/02* (2013.01); *H04S 7/303* (2013.01)

(58) Field of Classification Search
None
See application file for complete search history.

(56) References Cited

U.S. PATENT DOCUMENTS

2006/0109988 A1* 5/2006 Metcalf ..... H04S 3/002 381/104
2019/0116450 A1* 4/2019 Tsingos ..... H04S 7/307

* cited by examiner

*Primary Examiner* — James K Mooney

(57) ABSTRACT

An exemplary extended reality audio processing system ("processing system") and an exemplary extended reality audio rendering system ("rendering system") are disclosed to interoperate with one another to perform near-field and far-field audio reproduction. The processing system accesses audio data representative of virtual sound presented, within an extended reality world, to an avatar of a user experiencing the extended reality world. Based on the audio data, the processing system generates complementary first and second multi-channel audio data streams configured, in combination, to represent the virtual sound. The processing system directs the rendering system to concurrently render the complementary multi-channel audio data streams for the user by directing a near-field rendering system included within the rendering system to render the first multi-channel audio data stream, and directing a far-field rendering system included within the rendering system to render the second multi-channel audio data stream. Corresponding methods and systems are also disclosed.

20 Claims, 11 Drawing Sheets

METHODS AND SYSTEMS FOR EXTENDED REALITY AUDIO PROCESSING AND RENDERING FOR NEAR-FIELD AND FAR-FIELD AUDIO REPRODUCTION

BACKGROUND INFORMATION

Extended reality technologies (e.g., virtual reality technology, augmented reality technology, mixed reality technology, etc.) allow users to experience extended reality worlds. For example, extended reality worlds may be implemented as partially or fully simulated realities that do not exist in the real world as such, or that do exist in the real world but are difficult, inconvenient, expensive, or otherwise problematic for users to experience in real life (i.e., in a non-simulated manner). Extended reality technologies may thus provide users with a variety of entertainment experiences, educational experiences, vocational experiences, and/or other enjoyable or valuable experiences that may be difficult or inconvenient for the users to experience otherwise.

In order to provide an enjoyable and meaningful experience for a user, an exemplary extended reality world may include a complex soundscape of sounds from a variety of virtual sound sources in the extended reality world. For example, the soundscape may include sound effects originating from objects or events within the extended reality world, speech and/or sound effects made by players participating in or experiencing the extended reality world (e.g., avatars of other users, non-player characters ("NPCs"), artificial intelligences, etc.), media content being presented in the extended reality world (e.g., music playing over virtual loudspeakers, television or video presented on virtual screens, etc.), and so forth. Conventionally, the user may be presented with an audio reproduction of these and/or other sounds by way of a headset worn by the user as he or she experiences the extended reality world.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION OF PREFERRED EMBODIMENTS

Figure 1B:
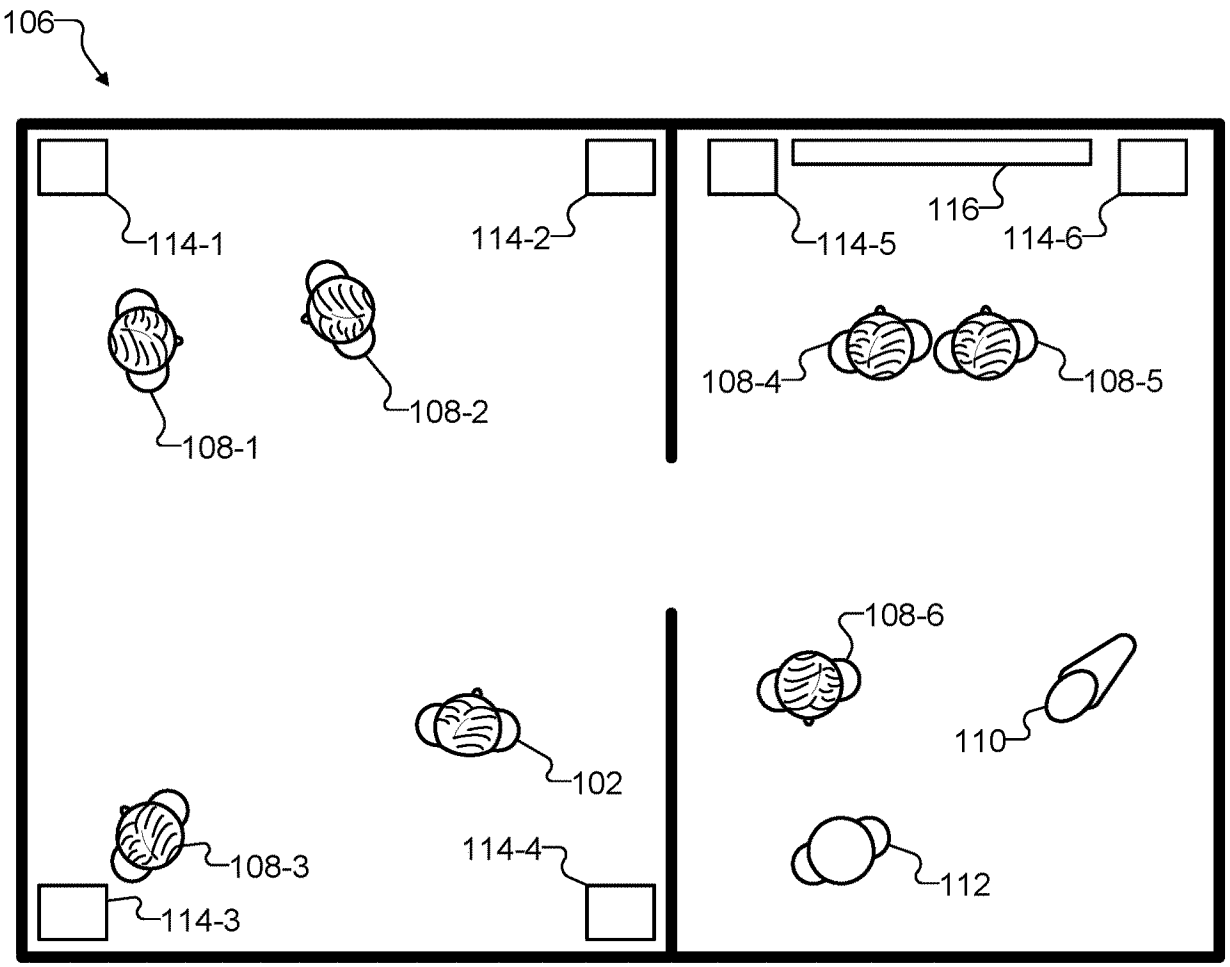
FIG. 1B illustrates an exemplary extended reality world being experienced by the user of FIG. 1A according to principles described herein.

Methods and systems for extended reality audio processing and rendering for near-field and far-field audio reproduction are described herein. For example, an extended reality audio processing system may access audio data representative of virtual sound presented, within an extended reality world, to an avatar of a user experiencing the extended reality world. The extended reality audio processing system may generate, based on the audio data, complementary first and second multi-channel audio data streams configured (in combination with one another) to represent the virtual sound presented to the avatar. During or subsequent to the generation of the complementary multi-channel audio data streams, the extended reality audio processing system may direct an extended reality audio rendering system to concurrently render the complementary first and second multi-channel audio data streams for the user. For instance, this directing may include or be performed by 1) directing a near-field rendering system included within the extended reality audio rendering system to render the first multi-channel audio data stream, and 2) directing a far-field rendering system included within the extended reality audio rendering system to render the second multi-channel audio data stream.

As another example, an extended reality audio rendering system may be integrated with and/or communicatively coupled and configured to interoperate with an extended reality audio processing system such as the exemplary extended reality audio processing system described above. The extended reality audio rendering system may receive instruction from the extended reality audio processing system to concurrently render, for a user, complementary first and second multi-channel audio data streams. For example, as described above, the complementary first and second multi-channel audio data streams may be originated by the extended reality audio processing system in the ways described above (e.g., by accessing audio data representative of virtual sound presented to an avatar of the user as the user experiences the extended reality world, and generating the complementary first and second multi-channel audio data streams to represent the virtual sound based on the audio data). As the complementary multi-channel audio data streams are being received (or subsequent to the streams being received), a near-field rendering system included within the extended reality audio rendering system may render the first multi-channel audio data stream. For example, the near-field rendering system may render the first multi-channel audio data stream based on the instruction received from the extended reality audio processing system. Concurrently with the rendering of the first multi-channel audio data stream, a far-field rendering system included within the extended reality audio rendering system may render the second multi-channel audio data stream based on the instruction received from the extended reality audio processing system.

One specific example illustrating how extended reality audio processing and rendering systems may function and interoperate will now be provided, and more detail and examples will be described in below. A user may experience an extended reality world such as a virtual reality world, an augmented reality world (i.e., an augmented version of the real world), or the like. For instance, the user may experience the extended reality world using a media player device that incorporates one or more display screens (e.g., display screens built into an immersive head-worn display device) and one or more audio reproduction devices. It may be desirable for the video and audio presented to the user to be as realistic and immersive as possible to allow the user to have a believable and enjoyable extended reality experience. To this end, the extended reality audio systems described herein may be configured to reproduce audio presented to the user using multiple types of reproduction devices or rendering systems that have complementary advantages.

Certain conventional media player devices for presenting extended reality worlds provide audio to the user using stereo headphones (e.g., on-ear or around-ear headphones, in-ear earbuds, etc.) worn by the user. In these examples, loudspeakers generating sound heard by the user are in relatively close proximity to the ears of the user (e.g., within a few centimeters of the user's ear canal), such that the stereo headphones may be considered to be a near-field rendering system. Such near-field rendering systems reproduce certain types of sounds very faithfully and in a way that is pleasing and easy for the user to hear and interpret. For instance, high frequencies (e.g., including various frequencies included in typical human speech) may be filtered out of sound that propagates long distances through the air, and thus may sound ideal (e.g., crisp, clear, easy to understand, etc.) when reproduced by a near-field rendering system.

Other conventional media player devices for presenting extended reality worlds provide audio to the user using one or more loudspeakers (e.g., stereo speakers next to a television or computer monitor, speakers placed around the room in a surround sound setup, etc.). Such loudspeakers generate sound from a position relatively far away from the ears of the user (e.g., several meters away in certain examples), such that the array of loudspeakers may be considered to be a far-field rendering system. Such far-field rendering systems tend to be less ideal for reproducing the types of sounds described above (i.e., the sounds that near-field rendering systems excel at reproducing), but also have their own strengths. For instance, lower frequencies and large sounds (e.g., sound effects from vehicles, explosions, large animals, etc.) may sound tinny or artificial when rendered by even very high quality stereo headphones, but may sound and feel realistic and immersive when reproduced by a far-field rendering system.

Accordingly, to provide the advantages and benefits of both near-field and far-field rendering systems for different types of sounds, the extended reality audio processing and rendering methods and systems described herein employ a hybrid approach that takes advantage of both near-field rendering systems and far-field rendering systems. For instance, stereo headphones configured to allow sound to pass through (e.g., open-back headphones, bone conduction headphones, headphones with an ambient pass-through feature, headphones that do not cancel noise or actively block ambient sound, etc.) may be worn by the user while the user also is in a room having an array of loudspeakers (e.g., a surround sound setup). As will be described in more detail below, an extended reality audio processing system may separate sound to be presented to the user into first and second multi-channel audio data streams that, in combination with one another, include all the components of the sound. For instance, one multi-channel audio data stream may be associated with certain sound sources in the extended reality world and the other multi-channel audio data stream may be associated with other sound sources; one multi-channel audio data stream may be associated with one frequency range and the other multi-channel audio data stream may be associated with a different frequency range; or the sound may be separated into complementary multi-channel audio data streams in another suitable way that may serve a particular implementation. The first and second multi-channel audio data streams may be presented to the user concurrently so that certain sounds (e.g., speech, higher frequencies, etc.) may be presented by the stereo headphones at the same time that other sounds (e.g., sound effects, lower frequencies, etc.) are presented by the array of loudspeakers. In this way, a complex soundscape of the extended reality world may sound highly realistic and the user may enjoy a highly immersive extended reality experience.

Various embodiments will now be described in more detail with reference to the figures. The disclosed systems and methods may provide one or more of the benefits mentioned above and/or various additional and/or alternative benefits that will be made apparent herein.

Figure 1A:
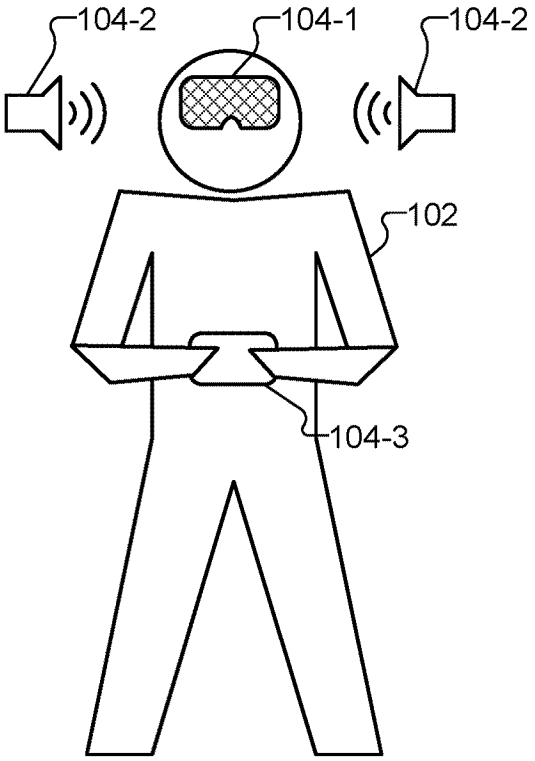
FIG. 1A illustrates an exemplary user experiencing an extended reality world according to principles described herein.

FIG. 1A illustrates an exemplary user 102 experiencing an extended reality world. As used herein, an extended reality world may refer to any world that may be presented to a user and that includes one or more immersive, virtual elements (i.e., elements that are made to appear to be in the world perceived by the user even though they are not physically part of the real-world environment in which the user is actually located). For example, an extended reality world may be a virtual reality world in which the entire real-world environment in which the user is located is replaced by a virtual world (e.g., a computer-generated virtual world, a virtual world based on a real-world scene that has been captured or is presently being captured with video footage from real world video cameras, etc.). As another example, an extended reality world may be an augmented or mixed reality world in which certain elements of the real-world environment in which the user is located remain in place while virtual elements are imposed onto the real-world environment. In still other examples, extended reality worlds may refer to immersive worlds at any point on a continuum of virtuality that extends from completely real to completely virtual.

In order to experience the extended reality world, FIG. 1A shows that user 102 may use a media player device that includes various components such as a video headset 104-1, an audio rendering system 104-2, a controller 104-3, and/or any other components as may serve a particular implementation (not explicitly shown). The media player device including components 104-1 through 104-3 will be referred to herein as media player device 104, and it will be understood that media player device 104 may take any form as may serve a particular implementation. For instance, in certain examples, video headset 104-1 may be configured to be worn on the head and to present video to the eyes of user 102, whereas, in other examples, a handheld or stationary device (e.g., a smartphone or tablet device, a television screen, a computer monitor, etc.) may be configured to present the video instead of the head-worn video headset 104-1. As will be described in more detail below, audio rendering system 104-2 may represent either or both of a near-field rendering system (e.g., stereo headphones integrated with video headset 104-1, etc.) and a far-field rendering system (e.g., an array of loudspeakers in a surround sound configuration). Controller 104-3 may be implemented as a physical controller held and manipulated by user 102 in certain implementations. In other implementations, no physical controller may be employed, but, rather, user control may be detected by way of head turns of user 102, hand or other gestures of user 102, or other suitable methods.

FIG. 1B illustrates an exemplary extended reality world 106 ("world 106") that user 102 is experiencing using media player device 104. World 106 includes a variety of distinct virtual sound sources that will now be described, thereby giving world 106 a somewhat complex soundscape for illustrative purposes. It will be understood, however, that world 106 is exemplary only, and that other implementations of world 106 may be any size (e.g., including much larger than world 106), may include any number of virtual sound sources (e.g., including dozens or hundreds of virtual sound sources or more in certain implementations), and may include any number and/or geometry of objects.

The exemplary implementation of world 106 illustrated in FIG. 1B is a multi-user extended reality world being jointly experienced by a plurality of users including user 102 and several additional users. As such, world 106 is shown to include, from an overhead view, two rooms within which a variety of characters (e.g., avatars of users, as well as other types of characters described below) are included. Specifically, the characters shown in world 106 include a plurality of avatars 108 (i.e., avatars 108-1 through 108-6) of the additional users experiencing world 106 with user 102, a non-player character 110 (e.g., a virtual person, a virtual animal or other creature, etc., that is not associated with a user), and an embodied intelligent assistant 112 (e.g., an embodied assistant implementing APPLE's "Siri," AMAZON's "Alexa," etc.). Moreover, world 106 includes a plurality of virtual loudspeakers 114 (e.g., loudspeakers 114-1 through 114-6) that may present diegetic media content (i.e., media content that is to be perceived as originating at a particular source within world 106 rather than as originating from a non-diegetic source that is not part of world 106), and so forth.

As user 102 experiences world 106, various sounds may be presented to user 102 by audio rendering system 104-2. For example, the sounds presented by audio rendering system 104-2 may correspond to virtual sound (e.g., composed of sound from a variety of virtual sound sources) that is presented to an avatar of user 102 in world 106. As shown, the avatar of user 102 is labeled with a reference designator 102 and, as such, may be referred to herein as "avatar 102." It will be understood that avatar 102 may be a virtual embodiment of user 102 within world 106. Accordingly, for example, when user 102 turns his or her head in the real world (e.g., as detected by media player device 104), avatar 102 may correspondingly turn his or her head in world 106. User 102 may not actually see avatar 102 in his or her view of world 106 because the field of view of user 102 is simulated to be the field of view of avatar 102. However, even if not explicitly seen, it will be understood that avatar 102 may still be modeled in terms of characteristics that may affect sound propagation (e.g., head pose, head shadow, etc.). Additionally, in examples such as world 106 in which multiple users are experiencing the extended reality world together, other users may be able to see and interact with avatar 102, just as user 102 may be able to see and interact with avatars 108 from the vantage point of avatar 102.

The sound presented to avatar 102 within world 106 (and thereby also presented to user 102 by audio rendering system 104-2) may include virtual sound from various sources. For example, sound may originate from interactions between characters in world 106, from objects included in the world (e.g., sound effects based on interactions between characters and objects in the world, ambient or environmental sounds, etc.), and so forth. To illustrate, FIG. 1B shows avatars 108-1 and 108-2 engaged in a virtual chat with one another, avatar 108-3 engaged in a phone call with someone who is not represented by an avatar within world 106, avatars 108-4 and 108-5 engaged in listening to and/or discussing media content being presented within world 106 on a virtual screen 116, avatar 108-6 giving instructions or asking questions to the embodied intelligent assistant 112 (which intelligent assistant 112 may respond to), non-player character 110 making sound effects or the like as it moves about within world 106, and so forth. Additionally, virtual loudspeakers 114 may originate sound such as media content to be enjoyed by users experiencing the world. For instance, virtual loudspeakers 114-1 through 114-4 may present background music or the like, while virtual loudspeakers 114-5 and 114-6 may present audio content associated with a video presentation being shown on virtual screen 116.

As various virtual sounds originate and are presented to avatar 102, propagation effects of these virtual sounds to avatar 102 may be simulated. Specifically, virtual sounds originating from each of characters 108 through 112 and/or virtual loudspeakers 114 may propagate through world 106 to reach the virtual ears of avatar 102 in a manner that simulates the propagation of sound in a real-world scene equivalent to world 106. As one example, the pose of the head of avatar 102 (i.e., the location and orientation of the head) in relation to virtual sound sources in world 106, which may be based on head movements and control actions of user 102, may be accounted for in the sound presented to user 102. Specifically, for instance, virtual sounds that originate from locations relatively nearby avatar 102 and/or toward which avatar 102 is facing may be reproduced such that avatar 102 may hear the sounds relatively well (e.g., because they are relatively loud, etc.), while virtual sounds that originate from locations relatively far away from avatar 102 and/or from which avatar 102 is turned away may be reproduced such that avatar 102 may hear the sounds relatively poorly (e.g., because they are relatively quiet, etc.). Additionally, various objects such as walls or other objects not explicitly shown in FIG. 1B may be simulated to reflect, occlude, or otherwise affect virtual sounds propagating through world 106 in any manner as may be modeled within a particular implementation. For example, walls may create reverberation zones that block or muffle virtual sounds from propagating from one room to the other in world 106. Additionally, virtual objects such as furniture or the like may similarly be simulated to absorb, occlude, or otherwise affect the propagation of virtual sounds within world 106.

As user 102 experiences world 106 using media player device 104, media player device 104 may incorporate, be a part of, be communicatively coupled to, or be otherwise associated with an extended reality audio system. For example, the extended reality audio system may incorporate an extended reality audio processing system and/or an extended reality audio rendering system configured to provide or facilitate near-field and far-field audio reproduction for user 102.

Figure 2:
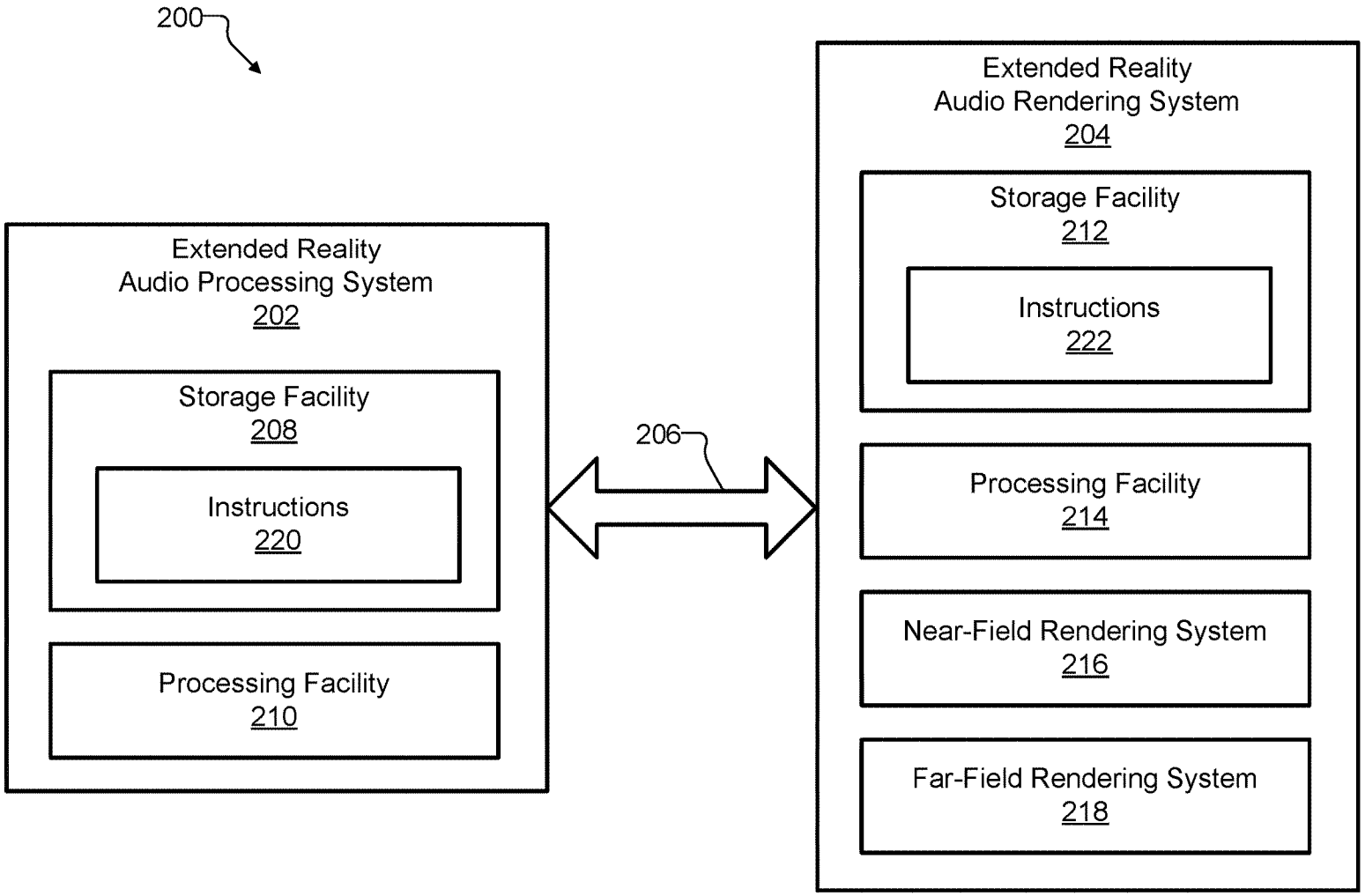
FIG. 2 illustrates an exemplary extended reality audio system including an extended reality audio processing system and an extended reality audio rendering system according to principles described herein.

To illustrate, FIG. 2 shows such an extended reality audio system 200 ("audio system 200"). Specifically, as shown, audio system 200 includes an extended reality audio processing system 202 ("processing system 202") and an extended reality audio rendering system 204 ("rendering system 204") communicatively coupled together by way of a communicative interface 206.

As depicted in FIG. 2, processing system 202 may include, without limitation, a storage facility 208 and a processing facility 210 selectively and communicatively coupled to one another. Facilities 208 and 210 may each include or be implemented by hardware and/or software components (e.g., processors, memories, communication interfaces, instructions stored in memory for execution by the processors, etc.). In some examples, facilities 208 and 210 may be distributed between multiple devices and/or multiple locations as may serve a particular implementation.

Similarly, as shown, rendering system 204 may include, without limitation, a storage facility 212 and a processing facility 214 selectively and communicatively coupled to one another. Additionally, rendering system 204 may include a near-field rendering system 216 and a far-field rendering system 218. Facilities 212 and 214 may each include or be implemented by hardware and/or software components (e.g., processors, memories, communication interfaces, instructions stored in memory for execution by the processors, etc.), while rendering systems 216 and 218 may include or be implemented by one or more loudspeakers (e.g., loudspeakers integrated within a set of stereo headphones, standalone loudspeakers in a surround sound setup, subwoofers, etc.) or other such devices capable of generating sound to be presented to a user. In some examples, facilities 212 and 214 and rendering systems 216 and 218 may be distributed between multiple devices and/or multiple locations as may serve a particular implementation.

In some implementations, audio system 200 may be configured to provide near-field and far-field audio reproduction in real time. As used herein, a function may be said to be performed in real time when the function relates to or is based on dynamic, time-sensitive information (e.g., audio data representative of sound being presented to avatar 102 in world 106, real-time head pose data representative of which direction avatar 102 is facing with respect to one or more virtual sound sources, etc.) and the function is performed while the time-sensitive information remains accurate or otherwise relevant. Due to processing times, communication latency, and other inherent delays in physical systems, certain functions may be considered to be performed in real time when performed immediately and without undue delay, even if performed after small delay (e.g., a delay of a few tens of milliseconds or the like).

In these real-time implementations, the length of time that time-sensitive data remains relevant may be determined (as a particular implementation is being designed) based on psychoacoustic considerations associated with users who will use audio system 200. For instance, in some examples, it may be determined that audio that is responsive to user actions (e.g., head movements, etc.) within approximately 20-50 milliseconds ("ms") may not be noticed or perceived by most users as a delay or a lag, while longer periods of latency such as a lag of greater than 100 ms may be distracting and disruptive to the immersiveness of a scene. As such, in these examples, real-time operations may be those performed within milliseconds (e.g., less than about 20-50 ms, less than 100 ms, etc.) so as to dynamically provide an immersive, up-to-date audio stream to the user that accounts for changes occurring in the characteristics that affect the propagation of virtual sounds to the avatar (e.g., including the head movements of the user, etc.).

Each of the facilities and subsystems of systems 202 and 204 within audio system 200 will now be described in more detail.

Storage facilities 208 and 212 may each maintain (e.g., store) executable data used by processing facilities 210 and 214, respectively, to perform any of the functionality described herein. For example, storage facility 208 may store instructions 220 that may be executed by processing facility 210 and storage facility 212 may store instructions 222 that may be executed by processing facility 214. Instructions 220 and/or instructions 222 may be executed by facilities 210 and/or 214, respectively, to perform any of the functionality described herein. Instructions 220 and 222 may be implemented by any suitable application, software, code, and/or other executable data instance. Additionally, storage facilities 208 and/or 212 may also maintain any other data received, generated, managed, used, and/or transmitted by processing facilities 210 or 214 as may serve a particular implementation.

Processing facility 210 may be configured to perform (e.g., execute instructions 220 stored in storage facility 208 to perform) various data and signal processing functions associated with near-field and far-field audio reproduction. For example, processing facility 210 may be configured to access audio data representative of virtual sound presented to an avatar of a user experiencing an extended reality world, and to generate (e.g., based on the audio data) complementary first and second multi-channel audio data streams.

Processing facility 210 may generate the first and second multi-channel audio data streams to be complementary in the sense that the multi-channel audio data streams may be configured, in combination with one another, to represent each component of the virtual sound presented to the avatar even while neither multi-channel audio data stream represents all of the components of the virtual sound by itself. For example, different components of the virtual sound may include sounds originating from different virtual sound sources in certain examples, sounds within different frequency ranges in other examples, or other types of sound components in still other examples. Regardless of how the components of the virtual sound may be divided up in a certain implementation, each of the first and second multi-channel audio data streams may be configured to represent one or more components of the virtual sound while not representing one or more other components of the virtual sound (e.g., components that are represented by the other complementary multi-channel audio data stream). For example, if the virtual sound presented to the avatar includes sounds originating from seven different virtual sound sources such as avatars 108-1 through 108-3 and virtual loudspeakers 114-1 through 114-4 in world 106, certain sounds (e.g., those originating from avatars 108-1 through 108-3) may be represented in the first multi-channel audio data stream, while other sounds (e.g., those originating from virtual loudspeakers 114-1 through 114-4) may be represented in the complementary second multi-channel audio data stream. As another example, relatively high-frequency components of sounds originating from all of the seven virtual sound sources could be represented in the first multi-channel audio data stream while relatively low-frequency components of sounds originating from these seven virtual sound sources could be represented in the complementary second multi-channel audio data stream.

While these specific examples of complementary multi-channel audio data streams describe different types of components of virtual sounds that are each represented either by one multi-channel audio data stream or the other in the complementary pair of multi-channel audio data streams, it will be understood that, in certain examples, one or more sound components may be represented by both complementary multi-channel audio data streams. In this way, while various sound components may be rendered on either a near-field rendering system or a far-field rendering system for user 102, other sound components may be rendered on both the near-field rendering system and the far-field rendering system, thereby emphasizing those sound components or giving them a more dramatic, massive, omnipresent, or otherworldly effect. At the same time, it will be understood that, even if certain components may overlap between the two complementary multi-channel audio data streams, the multi-channel audio data streams are not identical. Rather, each multi-channel audio data stream represents certain sound components (e.g., certain sounds originating from certain sources, certain frequency ranges, etc.) that are not represented by the other multi-channel audio data stream. More specifically, for example, the first multi-channel audio data stream may represent a first component of the virtual sound that is not represented by the second multi-channel audio data stream, and the second multi-channel audio data stream may represent a second component of the virtual sound that is not represented by the first multi-channel audio data stream.

As processing facility 210 processes the audio data representative of the virtual sound to generate the complementary multi-channel audio data streams in any of these ways, processing system 202 may direct, by way of communicative interface 206, rendering system 204 to concurrently render the complementary first and second multi-channel audio data streams for the user. In this way, all of the components of the virtual sound (e.g., the first and second components mentioned in the example above) may be presented concurrently to the avatar so that the user hears the full sound. Processing facility 210 may direct rendering system 204 to concurrently render the first and second multi-channel audio data streams in any suitable way. For example, processing facility 210 may direct near-field rendering system 216 within rendering system 204 to render the first multi-channel audio data stream, while directing far-field rendering system 218 within rendering system 204 to render the second multi-channel audio data stream. To this end, communicative interface 206 may be implemented in any manner as may serve a particular implementation. For instance, in examples where processing system 202 and rendering system 204 are integrated together in a single device (e.g., an integrated audio device 200), communicative interface 206 may be implemented as an internal communication bus or may even be a symbolic interface rather than a real interface (e.g., if processing facilities 210 and 214 are implemented by the same hardware and/or software resources or the like). Conversely, in examples where processing system 202 and rendering system 204 are separate systems (e.g., a non-integrated audio device 200), communicative interface 206 may be implemented by one or more network interfaces or the like to allow processing system 202 to transmit data to and/or receive data from rendering system 204 in any of the ways described herein.

Referring now to rendering system 204, rendering system 204 may be configured to perform various rendering operations for near-field and far-field audio reproduction. For example, storage facility 212, as described above, may play an analogous role for rendering system 204 as storage facility 208 played for processing system 202. By executing instructions 222 stored within storage facility 212, processing facility 214 may be configured to receive instruction from processing system 202 to concurrently render the complementary first and second multi-channel audio data streams that processing system 202 originates in the ways described above.

Upon receiving the complementary multi-channel audio data streams, processing facility 214 may direct rendering systems 216 and 218 to concurrently render the first and second multi-channel audio data streams in accordance with the instruction and direction received from processing system 202. For example, near-field rendering system 216 may render, based on the instruction received from processing system 202, the first multi-channel audio data stream, while far-field rendering system 218 may render, based on the instruction received from processing system 202 and concurrently with the rendering of the first multi-channel audio data stream, the second multi-channel audio data stream.

Rendering systems 216 and 218 may be implemented by any suitable audio rendering devices as may serve a particular implementation. For instance, in certain examples, near-field rendering system 216 may include or be implemented by stereo headphones worn by the user as the user experiences the extended reality world, and the rendering of the first multi-channel audio data stream may include reproducing, by the stereo headphones, a component of the virtual sound represented by the first multi-channel audio data stream. Such stereo headphones may be implemented so as to not block out or cancel other sound from the outside world (e.g., sound that is to be reproduced by far-field rendering system 218). For example, outside sounds may be passively allowed to pass to the ears or actively reproduced by near-field rendering system 216 in any suitable manner. In one example, for instance, the stereo headphones of near-field rendering system 216 may be implemented as open-back headphones. In other examples, the stereo headphones may simply allow the outside sound in by not actively canceling it using an active noise canceling feature or the like. Certain stereo headphones may include a feature that actively captures and reproduces ambient sound in real-time.

In certain examples, near-field rendering system 216 may be implemented in other ways that do not include stereo headphones or any speakers that are physically worn by the user. For instance, various sound steering or beamforming techniques (e.g., wave-field synthesis, etc.) may be used to generate, from a relatively long distance (e.g., across the room), a sound that is presented directly to a particular ear of the user in a manner that is perceived by the user as a near field sound from a particular source or direction. As such, near-field rendering system 216 may be configured to track the ears of the user as the user experiences the extended reality world (e.g., as the user's head turns in different directions and so forth), and different audio channels from the first multi-channel audio data stream may be directed to each of the user's ears.

Somewhat in contrast to near-field rendering system 216, far-field rendering system 218 may include or be implemented by an array of loudspeakers positioned at locations around the user. For instance, the array of loudspeakers may be positioned on a border encompassing the user as the user experiences the extended reality world, such as by being positioned in locations around the room within which the user is located. As such, the rendering of the second multi-channel audio data stream by far-field rendering system 218 may include reproducing, by the array of loudspeakers, one or more components of the virtual sound represented by the second multi-channel audio data stream. Far-field rendering system 218 may be implemented by or associated with any of various types of surround sound audio rendering systems including any suitable plural number of loudspeakers positioned in any suitable configuration. For instance, far-field rendering system 218 may be implemented by a stereo system, a 4.1 surround sound system, a 5.1 surround sound system, a 7.1 surround sound system, an Ambisonic surround sound system, or any other suitable array of loudspeakers as may serve a particular implementation.

Figure 3:
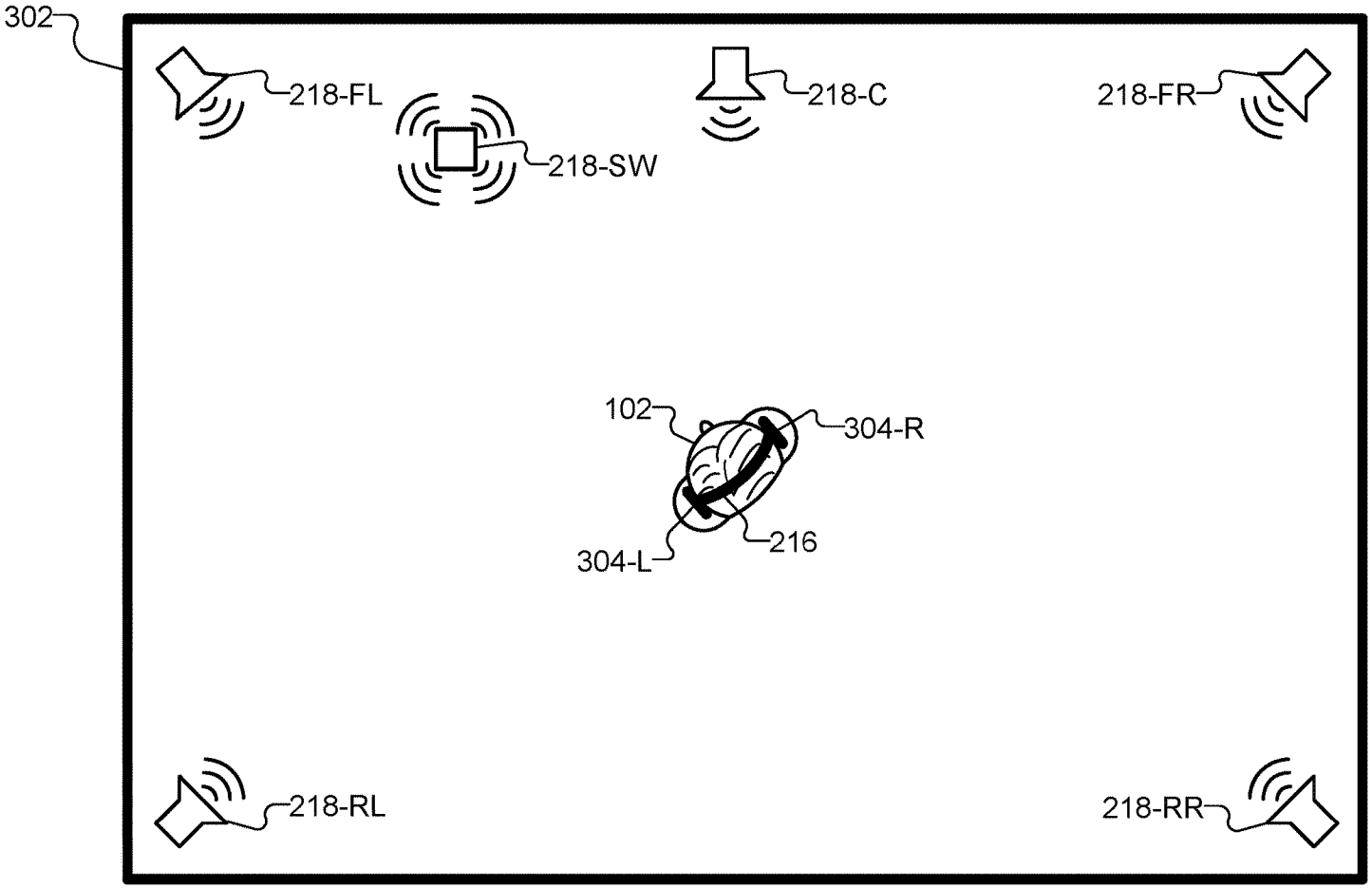
FIG. 3 illustrates a user experiencing an extended reality world using the extended reality audio system of FIG. 2 according to principles described herein.

To illustrate, FIG. 3 shows user 102 experiencing world 106 using audio system 200. Specifically, user 102 is shown to be located in a room 302 which may represent any real-world location within which user 102 may experience world 106. As shown within room 302, FIG. 3 depicts near-field rendering system 216 to be implemented by a pair of stereo headphones that include respective loudspeakers 304 (i.e., loudspeakers 304-L and 304-R) and that are worn by user 102 with loudspeaker 304-L presenting sound to the left ear of user 102 and loudspeaker 304-R presenting sound to the right ear of user 102. As additionally illustrated in this example, far-field rendering system 218 may be implemented by a 5.1 surround sound system made up of an array of loudspeakers including a front-left loudspeaker 218-FL, a center loudspeaker 218-C, a front-right loudspeaker 218-FR, a rear-left loudspeaker 218-RL, a rear-right loudspeaker 218-RR, and a subwoofer 218-SW. Collectively, the loudspeakers in this array of loudspeakers making up far-field rendering system 218 may be referred to as loudspeakers 218. While other components of audio system 200 such as the processors, memories, and so forth of processing system 202 and rendering system 204 are not explicitly shown in FIG. 3, it will be understood that these components may be implemented in any manner as may serve a particular implementation. For instance, facilities 208, 210, 212, and/or 214 may be integrated with any of the loudspeakers, stereo headphones or other devices shown in FIG. 3, or with any other device or system located within room 302 or at another suitable location (e.g., a video headset similar to video headset 104-1 described above, a controller similar to controller 104-3 described above, a provider system located external to room 302, etc.).

As user 102 experiences world 106 from within room 302, audio system 200 may track various motions of user 102 such as head motions or the like (e.g., to thereby track which direction user 102 is facing at any given moment during the experience). As shown in FIG. 3, loudspeakers 304 of the stereo headphones implementing near-field rendering system 216 move with the respective ears of user 102 as user 102 turns his or her head during the extended reality experience. In contrast, however, loudspeakers 218 of the surround sound loudspeaker array implementing far-field rendering system 218 remain statically located in room 302 regardless of how user 102 moves his or her head during the extended reality experience. Accordingly, audio system 200 (e.g., processing system 202) may generate the first multi-channel audio data stream (which is to be rendered by near-field rendering system 216) to account in real time for the motions of user 102, while generating the second multi-channel audio data stream (which is to be rendered by far-field rendering system 218) not to account for these motions in the same way.

The generation of the multi-channel audio data streams to account for (or abstain from accounting for) the movements of user 102 may be performed in any suitable way. For example, processing system 202 may be configured to access head pose data that dynamically represents a current position and orientation of a head of avatar 102 in relation to one or more virtual sound sources in world 106 as the virtual sound propagates to avatar 102 within world 106. Then, having accessed this head pose data, processing system 202 may perform the generating of the complementary first and second multi-channel audio data streams by accounting for the head pose data in the generating of the first multi-channel audio data stream based on the audio data, while abstaining from accounting for the head pose data in the generating of the second multi-channel audio data stream based on the audio data.

Audio system 200 may be used in conjunction with systems that provide video components of extended reality content for a variety of use cases. For example, certain configurations may employ audio system 200 to provide a single-user extended reality experience such as for a user playing a single-player game, watching an extended reality media program such as an extended reality television show or movie, or the like. Other configurations may employ audio system 200 in a manner that serves a plurality of users. For instance, a multi-user extended reality world may be associated with a multi-player game, a multi-user chat or "hangout" environment, an emergency command center, or any other extended reality world that may be co-experienced by a plurality of users simultaneously. Still other configurations may employ audio system 200 in a manner that provides extended reality content representative of live, real-time capture of real-world events such as athletic events, concerts or theatrical events, and so forth. It will be understood that various other use cases not explicitly described herein may also be served by certain implementations of audio system 200. For example, such use cases may involve volumetric virtual reality use cases in which real-world scenes are captured (e.g., not necessarily in real-time or for live events), virtual reality use cases involving completely virtualized (i.e., computer-generated) representations, augmented reality use cases in which certain objects are imposed over a view of the actual real-world environment within which the user is located, video game use cases involving conventional 3D video games, and so forth.

In any of these or other suitable configurations and use cases, audio system 200, including both processing system 202 and rendering system 204, may be implemented in any suitable manner. For example, processing system 202 may be implemented on a server side of a server-client architecture, and may transmit data representative of two complementary multi-channel audio data streams over a network to rendering system 204, which may be implemented on a client side of the server-client architecture. In certain implementations, for instance, processing system 202 may be implemented on a network-edge-deployed server to provide processing services with minimal lag (e.g., 10-20 ms in certain examples) so as to provide data that is perceived by the user as being processed instantaneously as the user moves his or her head to look in different directions during the extended reality experience. In other examples, both processing system 202 and rendering system 204 may be implemented on the client side such as by both being integrated together into a single system (e.g., integrated into media player device 104 or the like). In still other examples, processing system 202 may be distributed over both the server side (e.g., implemented on a network-edge-deployed server or the like) and the client side so as to perform certain processing-intensive operations on a relatively resource-rich server maintained by the provider (e.g., the network-edge-deployed server) while performing less processing-intensive operations on media player device 104, which may have more limited processing resources.

Figure 4A:
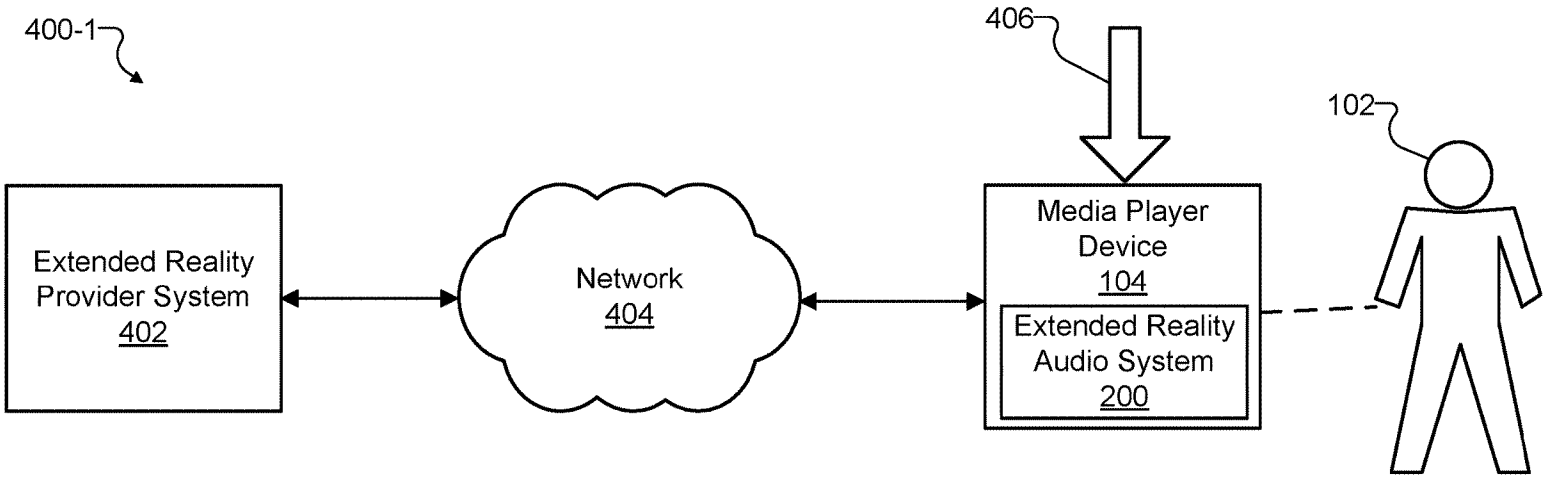
FIGS. 4A-4B illustrate exemplary configurations in which the extended reality audio processing and rendering systems of the extended reality audio system of FIG. 2 operate according to principles described herein.
Figure 4B:
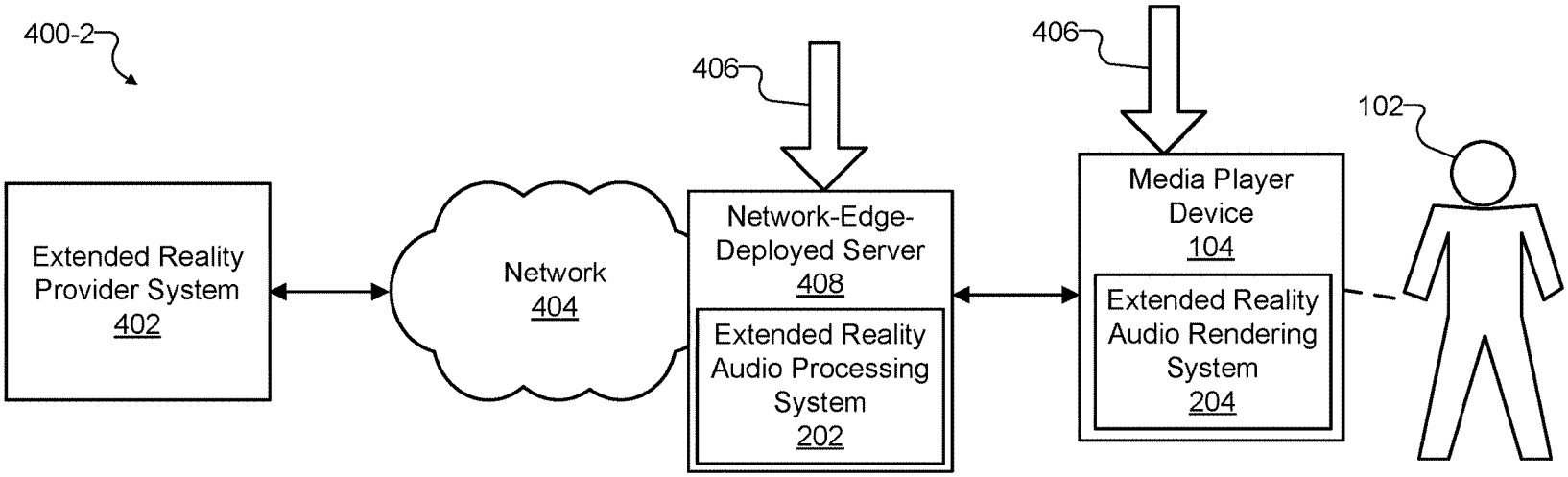

To illustrate a few such examples, FIGS. 4A and 4B illustrate exemplary configurations within which processing system 202 and rendering system 204 of audio system 200 may operate.

First, FIG. 4A shows a configuration 400-1 in which audio system 200 is fully implemented by media player device 104. In FIG. 4A, an extended reality provider system 402 is communicatively coupled with media player device 104 (which is used by user 102) by way of a network 404. Media player device 104 may receive various data representative of extended reality content from extended reality provider system 402 by way of network 404. Additionally, media player device 104 may access (e.g., request, receive, download, tune into, etc.) audio data 406 representative of virtual sound being presented within the extended reality world. Each of the components illustrated in configuration 400-1 will now be described in more detail.

Extended reality provider system 402 may be implemented by one or more computing devices or components managed and maintained by an entity that creates, generates, distributes, and/or otherwise provides extended reality media content to extended reality users such as user 102. For example, extended reality provider system 402 may include or be implemented by one or more server computers maintained by an extended reality provider. Extended reality provider system 402 may provide video data and/or other non-audio-related data representative of an extended reality world to media player device 104. Additionally, as will be described in more detail below, extended reality provider system 402 may be responsible for providing at least some of audio data 406 in certain implementations.

Network 404 may provide data delivery means between server-side extended reality provider system 402 and client-side devices such as media player device 104. In order to distribute extended reality media content from provider systems to client devices, network 404 may include a provider-specific wired or wireless network (e.g., a cable or satellite carrier network, a mobile telephone network, a traditional telephone network, a broadband cellular data network, etc.), the Internet, a wide area network, a local area network, a content delivery network, and/or any other suitable network or networks. Extended reality media content may be distributed using any suitable communication technologies implemented or employed by network 404. Accordingly, data may flow between extended reality provider system 402 and media player device 104 using any communication technologies, devices, media, and protocols as may serve a particular implementation.

Audio data 406 may include any audio data representative of any sound that may be present within world 106 (e.g., sound originating from any of the sound sources described above or any other suitable sound sources). For example, audio data 406 may be representative of voice chat spoken by one user to be heard by another user, sound effects originating from any object within world 106, sound associated with media content (e.g., music, television, movies, etc.) being presented on virtual screens or loudspeakers within world 106, synthesized audio generated by a non-player character or artificial intelligence within world 106, or any other sound as may serve a particular implementation.

Audio data 406 may be accessed by audio system 200, which is shown to be integrated with media player device 104 in configuration 400-1. Audio system 200 and media player device 104 were both described in detail above. As mentioned above, in certain examples, some or all of audio data 406 may be provided (e.g., along with various other extended reality media content) by extended reality provider system 402 over network 404. In the same or other examples, however, some or all of audio data 406 may be accessed from other sources such as from a media content broadcast (e.g., a television, radio, or cable broadcast), another source unrelated to the extended reality provider, a storage facility of audio system 200 (e.g., one of storage facilities 208 or 212), or any other audio data source as may serve a particular implementation.

Along with receiving extended reality media content from extended reality provider system 402 and accessing audio data 406, media player device 104 may also be configured to determine, generate, and provide various types of data that may be used by other systems to provide the extended reality experience. For example, media player device 104 may provide acoustic propagation data that helps describe or indicate of how virtual sound propagates within world 106, including head pose data representative of dynamic movements of user 102 while user 102 experiences the extended reality world. Examples of such data will be described in more detail below.

In some examples, audio system 200 may access certain audio data 406 from within media player device 104 or from a device or medium (e.g., disc, drive, etc.) associated with media player device 104. For example, audio system 200 may access audio data 406 that is encoded in a single multi-channel audio data stream (e.g., audio data in a standard 5.1 surround sound format). Such single multi-channel audio data streams may be present in various conventional surround sound media content such as media programs, games, and so forth. Upon accessing such audio data, audio system 200 may generate the complementary first and second multi-channel audio data streams by converting the single multi-channel audio data stream into the complementary first and second multi-channel audio data streams. For example, audio system 200 may convert the audio data in a standard 5.1 surround sound format into both a stereo audio data stream and a 5.1 surround sound audio data stream that complement one another in the ways described herein.

This conversion may be accomplished in any manner as may serve a particular implementation. For instance, starting with the single multi-channel audio data stream (e.g., the audio data encoded in the 5.1 surround sound format), audio system 200 may process each of the audio channels in the multi-channel audio data stream by decoding the channel and analyzing it with a Fast Fourier Transform ("FFT") to generate a high-frequency version and a low frequency version of the channel. The high-frequency version may include a frequency range that captures most audio components of the human voice, for example, while the low-frequency version may include a different frequency range (e.g., an overlapping frequency range, or a contiguous, non-overlapping frequency range) that captures lower audio components that are typical of larger sounds (e.g., explosions, ambient noise, vehicles or animals passing by, etc.). Audio system 200 may convert each of the channels into a channel-agnostic surround-sound form (e.g., an Ambisonic-related form such as a B-format Ambisonic signal or the like). As such, for example, audio system 200 may generate a high-frequency Ambisonic signal and a low-frequency Ambisonic signal, each of which may be readily converted to any desired form (e.g., stereo, 5.1 surround sound, 7.1 surround sound, etc.). The conversion may therefore be completed by rendering the high-frequency Ambisonic signal in a stereo format that can be reproduced on the stereo headphones of near-field rendering system 216, while rendering the low-frequency Ambisonic signal in a surround sound format (e.g., back into the 5.1 surround sound format, etc.) that can be reproduced on far-field rendering system 218.

In like manner as described above with reference to configuration 400-1 of FIG. 4A, FIG. 4B shows a configuration 400-2 in which an implementation of audio system 200 is distributed (i.e., split up) between media player device 104 and a network-edge-deployed server 408. As with configuration 400-1, configuration 400-2 includes extended reality provider system 402, network 404, media player device 104 and audio data 406 being accessed by audio system 200. However, in contrast with the implementation of audio system 200 shown in FIG. 4A, the implementation of audio system 200 depicted in FIG. 4B shows that processing system 202 of audio system 200 may be implemented by a device separate from media player device 104 (which may still implement the rendering system 204 component of audio system 200). As mentioned above, a network-edge-deployed server such as network-edge-deployed server 408 may be employed to perform certain processing operations on shared resources that promote processing and cost economy while not contributing noticeable latency or lag to the extended reality experience within which user 102 is engaged.

Network-edge-deployed server 408 may include one or more servers and/or other suitable computing systems or resources that may interoperate with media player device 104 with a low enough latency to allow for the real-time offloading of audio processing described herein. For example, network-edge-deployed server 408 may leverage mobile edge computing ("MEC") technologies to enable computing capabilities at the edge of a cellular network (e.g., a 5G cellular network in certain implementations, or any other suitable cellular network associated with any other generation of technology in other implementations). In other examples, network-edge-deployed server 408 may be even more localized to media player device 104, such as by being implemented by computing resources on a same local area network with media player device 104 (e.g., by computing resources located within a home or office of user 102), or the like.

As mentioned above, media player device 104 may, in some examples, be configured to determine, generate, and provide various types of data that may be used by other systems to provide the extended reality experience in addition to receiving extended reality media content from extended reality provider system 402 and accessing audio data 406. For example, media player device 104 may provide acoustic propagation data to network-edge-deployed server 408. Acoustic propagation data may include world propagation data as well as head pose data.

World propagation data, as used herein, may refer to data that dynamically describes propagation effects of a variety of virtual sound sources from which virtual sounds heard by avatar 102 may originate. For example, world propagation data may include real-time information about poses, sizes, shapes, materials, and environmental considerations of one or more virtual sound sources included in world 106. Thus, for example, if an avatar of another user turns to face avatar 102 directly or moves closer to avatar 102, world propagation data may include data describing this change in pose that may be used to make the audio more prominent (e.g., louder, more pronounced, etc.) in complementary multi-channel audio data streams. In contrast, world propagation data may similarly include data describing a pose change of the virtual sound source when turning to face away from avatar 102 and/or moving farther from avatar 102, and this data may be used to make the audio less prominent (e.g., quieter, fainter, etc.) in the multi-channel audio data streams.

Head pose data may describe real-time pose changes of avatar 102 itself. For example, head pose data may describe movements (e.g., head turn movements, point-to-point walking movements, etc.) or control actions performed by user 102 that cause avatar 102 to change pose within world 106. When user 102 turns his or her head, for example, the interaural time differences, interaural level differences, and others cues that may assist user 102 in localizing sounds may need to be recalculated and adjusted in the first multi-channel audio data stream being provided to media player device 104 in order to properly model how virtual sound arrives at the virtual ears of avatar 102. Head pose data thus tracks these types of variables and provides them to processing system 202 so that head turns and other movements of user 102 may be accounted for in real time as the multi-channel audio data streams are generated and provided to media player device for presentation to user 102. For instance, based on head pose data, processing system 202 may use digital signal processing techniques to model virtual body parts of avatar 102 (e.g., the head, ears, pinnae, shoulders, etc.) and perform binaural rendering of audio data that accounts for how those virtual body parts affect the virtual propagation of sound to avatar 102. To this end, processing system 202 may determine a head related transfer function ("HRTF") for avatar 102 and may employ the HRTF as the digital signal processing is performed to generate the binaural rendering of the audio data so as to mimic the sound avatar 102 would hear if the virtual sound propagation and virtual body parts of avatar 102 were real.

Because of the low-latency nature of network-edge-deployed servers such as MEC servers or the like, audio system 200 may be configured to receive real-time acoustic propagation data from media player device 104 and return corresponding complementary multi-channel audio data streams to media player device 104 with a small enough delay that user 102 perceives the presented audio as being instantaneously responsive to his or her actions (e.g., head turns, etc.). For example, real-time acoustic propagation data accessed by network-edge-deployed server 408 may include head pose data representative of a real-time pose (e.g., including a position and an orientation) of avatar 102 at a first time while user 102 is experiencing world 206, and the transmitting of the first multi-channel audio data stream by processing system 202 may be performed so as to provide the multi-channel audio data stream to rendering system 204 at a second time that is within a predetermined latency threshold after the first time. For instance, the predetermined latency threshold may be about 10 ms, 20 ms, 50 ms, 100 ms, or any other suitable threshold amount of time that is determined, in a psychoacoustic analysis of users such as user 102, to result in sufficiently low-latency responsiveness to immerse the users in the extended reality world without perceiving that sound being presented has any delay.

Whether processing system 202 is implemented by media player device 104 as shown in FIG. 4A or on a server-side system such as network-edge-deployed server 408 as shown in FIG. 4B, processing system 202 may be configured to separate (e.g., split, divide, distinguish, etc.) sounds represented by audio data 406 to generate distinct (but complementary) multi-channel audio data streams. This separation of the sounds being presented to user 102 may be performed in various ways and/or based on various criteria in different implementations, as has been mentioned above and will be described in more detail below. However, it will be understood that, regardless of how the first multi-channel audio data stream may be separated from the second multi-channel audio data stream, each of the multi-channel audio data streams may include multiple channels of audio data that, in combination, provide audio for both ears of user 102. For example, in one multi-channel audio data stream, one channel may be a left channel and the other a right channel. As another example, another multi-channel audio data stream may include various channels each associated with different parts of the front and back and left and right sides of the room, such as illustrated by loudspeakers 218 in FIG. 3.

One way to separate audio data into distinct multi-channel audio data streams is separate sound originated by certain real or virtual sound sources from sound originated by other real or virtual sound sources. Specifically, if audio data 406 includes audio data from a set of distinct sound sources including any of the sound sources described herein (e.g., users associated with other avatars who wish to engage in an in-world chat, sound effects on disc, media content provided by a media content provider or broadcaster, etc.), the generating of the complementary first and second multi-channel audio data streams may comprise generating different multi-channel audio data streams based on audio data from different sound sources within the set. For example, the generating of the first multi-channel audio data stream may be performed based on audio data from a first subset of the set of distinct sound sources, while the generating of the second multi-channel audio data stream may be performed based on audio data from a second subset of the set of distinct sound sources.

In these examples where sound is separated based on sound source, the first and second subsets of sound sources may overlap to some extent in certain examples. In other words, one or more particular sound sources may be included in both the first and second subsets. However, even in examples with overlapping subsets, the first and second subsets may still be different such that, for instance, at least one sound source is only included in the first or the second subset and not both.

Processing system 202 may assign different sound sources to different subsets of sound sources in these examples using any suitable criteria or methodology. For instance, in one example, the first subset of sound sources (e.g., which may correspond to the first multi-channel audio data stream that is to be rendered by the near-field rendering system) may include speech from only the closest avatar to avatar 102, while the second subset of sound sources (e.g., which may correspond to the second multi-channel audio data stream that is to be rendered by the far-field rendering system) may include sound effects from the closest avatar, as well as speech and sound effects from all other avatars and sound sources within world 106. In another example, the first subset of sound sources may include speech from all the avatars within a predetermined radius of avatar 102, while the second subset of sound sources includes sound effects from these avatars and speech and sound effects from other avatars and sound sources outside of the predetermined radius. In yet another example, the first subset of sound sources may include all speech sources and/or certain sound sources originating certain types of sounds (e.g., highly directional sounds, sounds originating very near to one or both ears of avatar 102 such as scissors giving a virtual haircut, etc.), while the second subset of sound sources includes all other sound sources not included in the first subset.

In other examples, the second subset of sound sources may include sound sources associated with certain types of sounds, and the first subset of sound sources may include the remainder of the sound sources. For example, processing system 202 may determine that the second subset of sound sources is to include all sources that originate background sounds (e.g., vehicles, ambient sounds, etc.), "large" sounds (e.g., large animals, explosions, etc.), non-directional sounds (e.g., sounds originating from faraway sound sources), non-diegetic sounds, and so forth, and that the first subset of sound sources is to include all other sound sources not included in the second subset.

Figure 5:
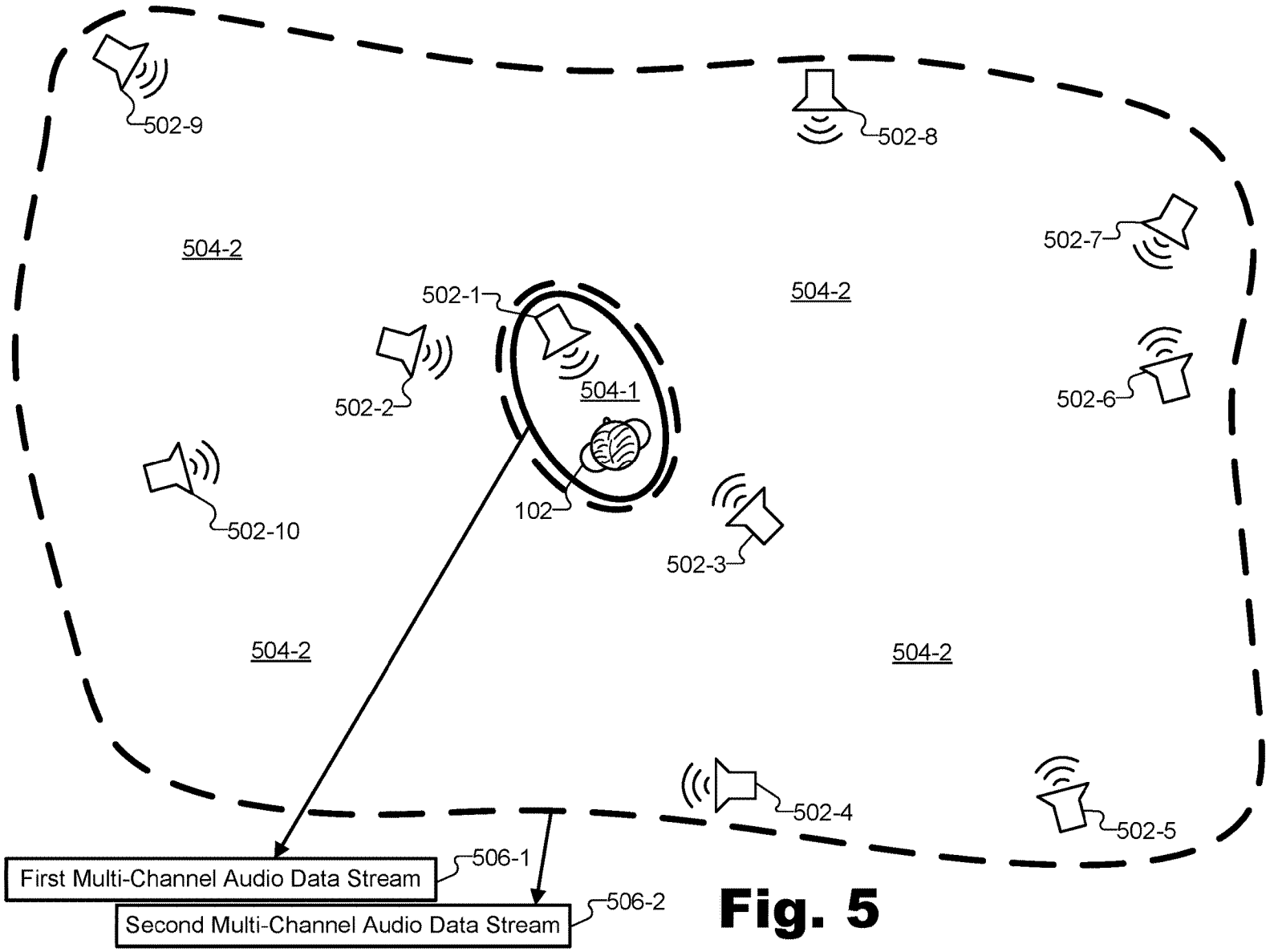
FIGS. 5-7 illustrate exemplary ways in which the extended reality audio system of FIG. 2 may generate complementary first and second multi-channel audio data streams according to principles described herein.
Figure 6:
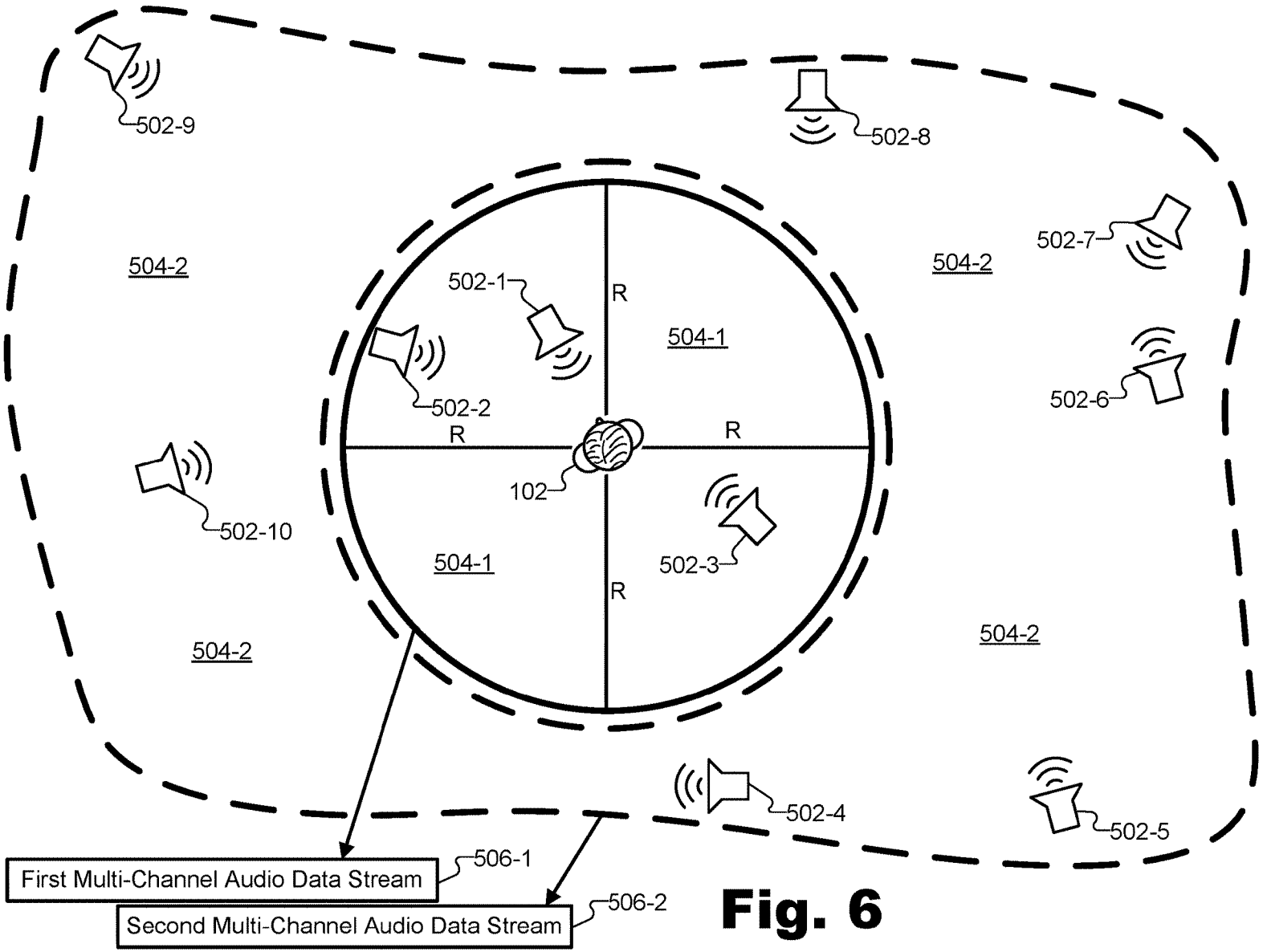
Figure 7:
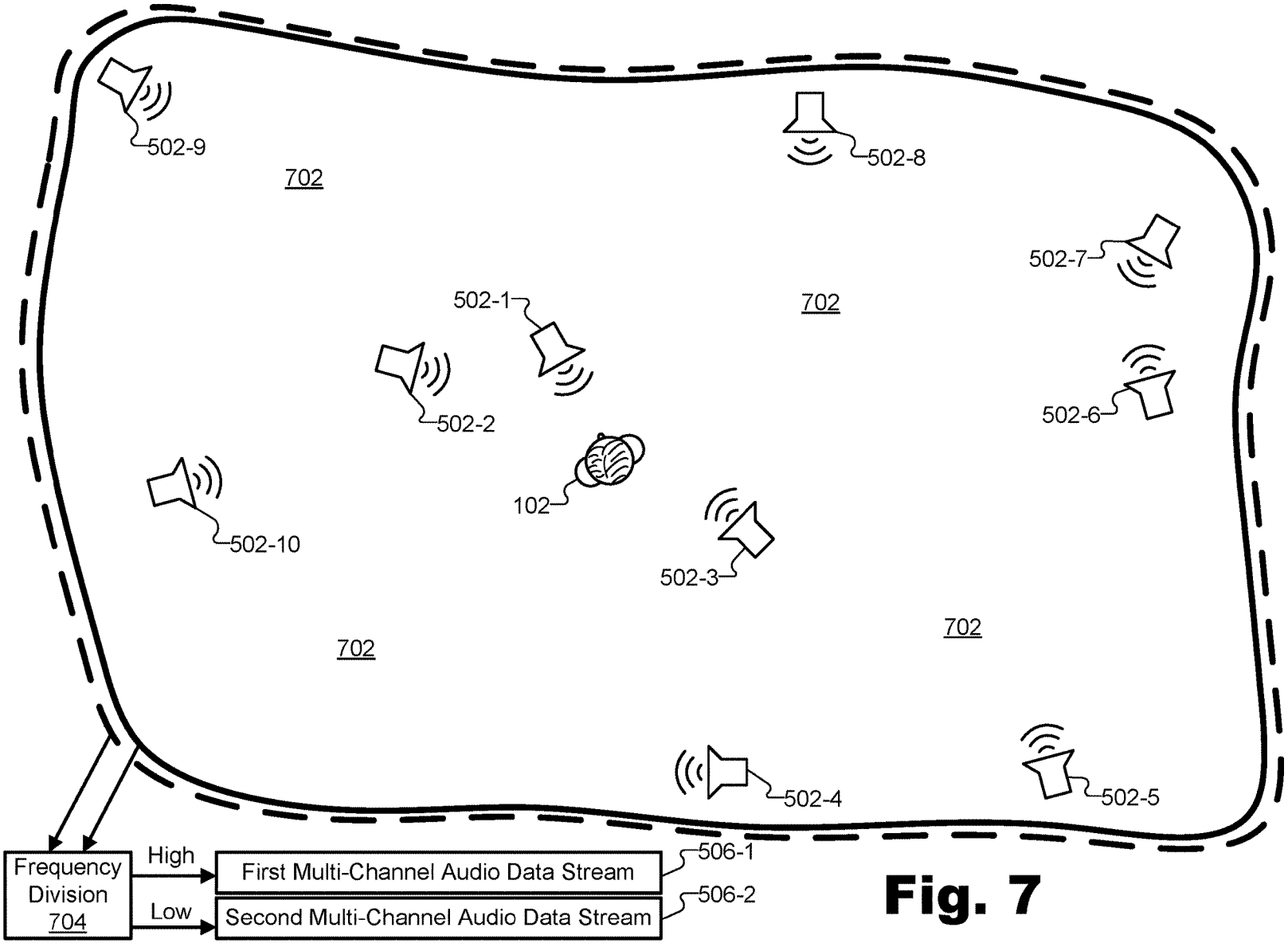

To illustrate, FIGS. 5-7 show exemplary ways in which audio system 200 may generate the complementary first and second multi-channel audio data streams. Specifically, as shown, each of FIGS. 5-7 depict avatar 102 as well as a set of virtual sound sources 502 (e.g., sound sources 502-1 through 502-10) disposed at different positions in relation to the virtual position of avatar 102. Sound sources 502 may each represent any of the types of sound sources described herein, such as another avatar (e.g., one of avatars 108), a non-player character (e.g., non-player character 110), an embodied intelligent assistant (e.g., intelligent assistant 112), a virtual loudspeaker (e.g., one of loudspeakers 114), or any other suitable virtual sound source.

As shown in each of FIGS. 5 and 6, a first subset of sound sources 502 are located within exemplary areas 504-1 that are demarcated by a solid line connected to an arrow indicating that the sound sources 502 within this area are assigned to a first multi-channel audio data stream 506-1. Additionally, in FIGS. 5 and 6, a second subset of sound sources 502 are located within another area 502-2 that is demarcated by dashed lines connected to an arrow indicating that the sound sources 502 within this area are assigned to a second multi-channel audio data stream 506-2.

More specifically, in FIG. 5, only the sound source 502 nearest to avatar 102 (i.e., sound source 502-1) is included within area 504-1 and assigned to first multi-channel audio data stream 506-1, while the remainder of the sound sources 502 (i.e., sound sources 502-2 through 502-10) are included within area 504-2 demarcated by dashed lines and indicated to be assigned to second multi-channel audio data stream 506-2. In contrast, in FIG. 6, all the sound sources 502 within a predetermined radius labeled "R" (i.e., sound sources 502-1, 502-2 and 502-3) are included within area 504-1 and assigned to first multi-channel audio data stream 506-1, while the sound sources 502 outside that radius (i.e., sound sources 502-4 through 504-10) are included within area 504-2 and assigned to second multi-channel audio data stream 506-2.

FIG. 7 illustrates a different way of separating sounds into the multi-channel audio data streams 506-1 and 506-2. Specifically, as illustrated in FIG. 7, the audio data 406 accessed by processing system 202 may include audio data representative of a first component (e.g., a high-frequency component) of the virtual sound within a first frequency range (e.g., a high frequency range), as well as audio data representative of a second component (e.g., a low-frequency component) of the virtual sound within a second frequency range distinct from the first frequency range (e.g., a low frequency range). A threshold separating the first and second frequency ranges may be set at any frequency. For example, the threshold may be set so as to make the first frequency range correspond to a range that includes typical human speech (e.g., frequencies above 500 Hz, etc.) while making the second frequency range correspond to a range that includes other types of non-speech sounds (e.g., low-frequency explosions, ambient noise, etc., that are composed of frequencies generally less than 500 Hz). In some examples, two or more thresholds may be selected such that the first and second frequency ranges include at least some overlap. For instance, the first frequency range may be set to 500 Hz and above while the second frequency range may be set to 1 kHz and below.

As shown in FIG. 7, all of sound sources 502 may be included in an area 702 that is encircled by both a solid and a dashed line to indicate that each of these sound sources may contribute to both multi-channel audio data streams 506-1 and 506-2. This is because, rather than dividing up the sound based on sound source in this example, processing system 202 may generate complementary multi-channel audio data streams 506-1 and 506-2 in FIG. 7 based on frequency. Specifically, processing system 202 may use a frequency division process 704 (e.g., an FFT analysis or the like) to separate audio data from each sound source 502 into the first component (labeled "High" in FIG. 7) and the second component (labeled "Low" in FIG. 7). Processing system 202 may then generate first multi-channel audio data stream 506-1 based on the audio data representative of the first component (i.e., the high-frequency component of the sound from all of sound sources 502), and generate second multi-channel audio data stream 506-2 based on the audio data representative of the second component (i.e., the low-frequency component of the sound from all of sound sources 502).

As mentioned above, in certain examples, multi-channel audio data streams are transmitted from one system to another. For example, as illustrated in FIG. 4B, multi-channel audio data may be transferred over a network from a server-side system (e.g., network-edge-deployed server 408 implementing processing system 202) to a client-side device (e.g., media player device 104 implementing rendering system 204). To effect such data transmissions, multiple signals each having a plurality of channels may be bundled together using any format as may serve a particular implementation.

Figure 8:
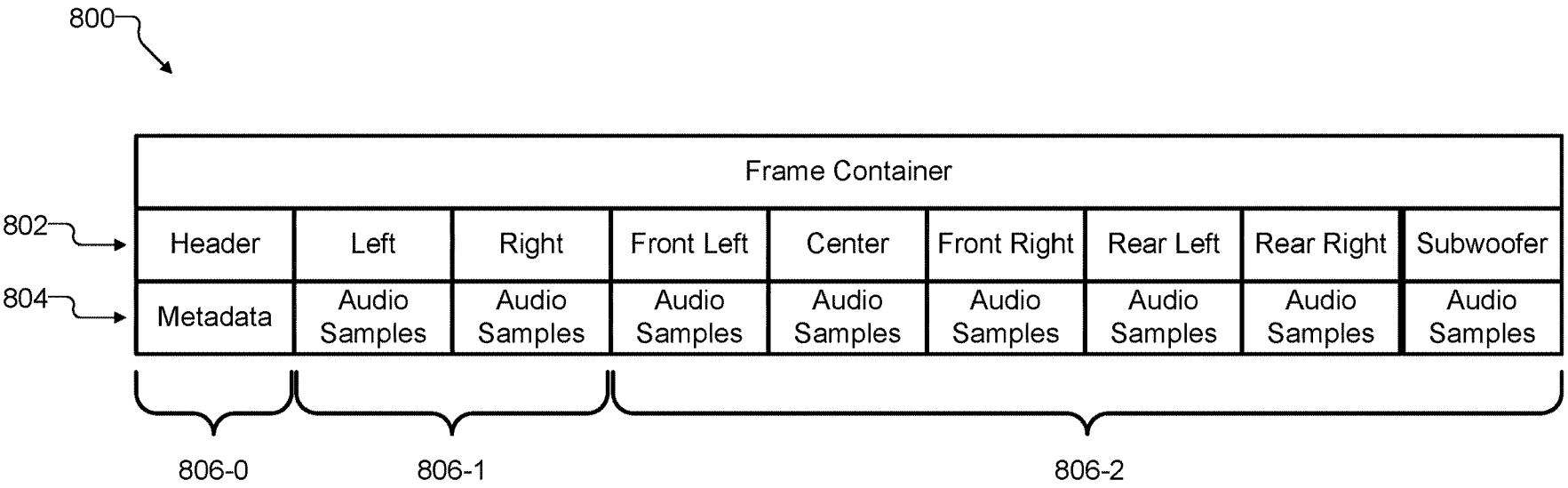
FIG. 8 illustrates an exemplary frame container for communicating complementary multi-channel audio data streams according to principles described herein.

For example, FIG. 8 illustrates an exemplary frame container 800 for communicating complementary multi-channel audio data streams such as multi-channel audio data streams 506-1 and 506-2. When multi-channel audio data from complementary streams is to be transmitted, a plurality of frames each taking the form of frame container 800 (or another suitable form) may be transmitted in a sequence such that, when data from the sequence of frames is reconstructed at the receiving end, audio data from each of the multiple channels may be usable by the receiving system (e.g., may be renderable for near-field and far-field audio reproduction by rendering system 204). As shown by frame container 800, each frame in such a sequence may include one or more audio samples for each channel in the first multi-channel audio data stream and one or more samples for each channel in the second multi-channel audio data stream.

Specifically, row 802 shows labels indicative of what type of data is included in different segments of frame container 800, while row 804 symbolically describes data in each of these segments. As shown, frame container 800 includes three portions 806 (i.e., portions 806-0 through 806-2) each including one or more data segments labeled and described by words in rows 802 and 804.

Portion 806-0 is a header portion that includes metadata indicating where different data segments and portions are located within the frame, which data segments represent channels belonging to the first multi-channel audio data stream and are to be rendered on the near-field rendering system, which data segments represent channels belonging to the second multi-channel audio data stream and are to be rendered on the far-field rendering system, and so forth.

Portion 806-1 includes audio samples for each channel in the first multi-channel audio data stream. More specifically, as shown in this particular example, portion 806-1 may include audio samples for a "Left" channel to be rendered by a left loudspeaker of stereo headphones of a near-field rendering system such as loudspeaker 304-L in FIG. 3, as well as audio samples for a "Right" channel to be rendered by a right loudspeaker of the stereo headphones such as loudspeaker 304-R.

Similarly, portion 806-2 includes audio samples for each channel in the second multi-channel audio data stream. More specifically, as shown in this particular example, portion 806-2 may include audio samples for a "Front Left" channel to be rendered in a front left loudspeaker of a far-field rendering system such as loudspeaker 218-FL in FIG. 3, audio samples for a "Center" channel to be rendered in a center loudspeaker such as loudspeaker 218-C, audio samples for a "Front Right" channel to be rendered in a front right loudspeaker such as loudspeaker 218-FR, audio samples for a "Rear Left" channel to be rendered in a rear left loudspeaker such as loudspeaker 218-RL, audio samples for a "Rear Right" channel to be rendered in a rear right loudspeaker such as loudspeaker 218-RR, and audio samples for a "Subwoofer" channel to be rendered in a subwoofer such as subwoofer 218-SW.

It will be understood that the portions and segments illustrated in frame container 800 are exemplary only and that, while each multi-channel audio data stream may include a plurality of channels, any suitable number of channels split up in any way may be used. For example, while frame container 800 depicts an example where the first multi-channel audio data stream includes a stereo signal with two channels and the second multi-channel audio data stream includes a 5.1 surround sound signal with six channels, it will be understood that, in other examples, other multi-channel signal types and formats (e.g., 4-channel formats, 6.1-channel formats, 7.1-channel formats, Ambisonic formats, etc.) may be used in addition or as an alternative to the signal types and formats shown in FIG. 8.

Figure 9:
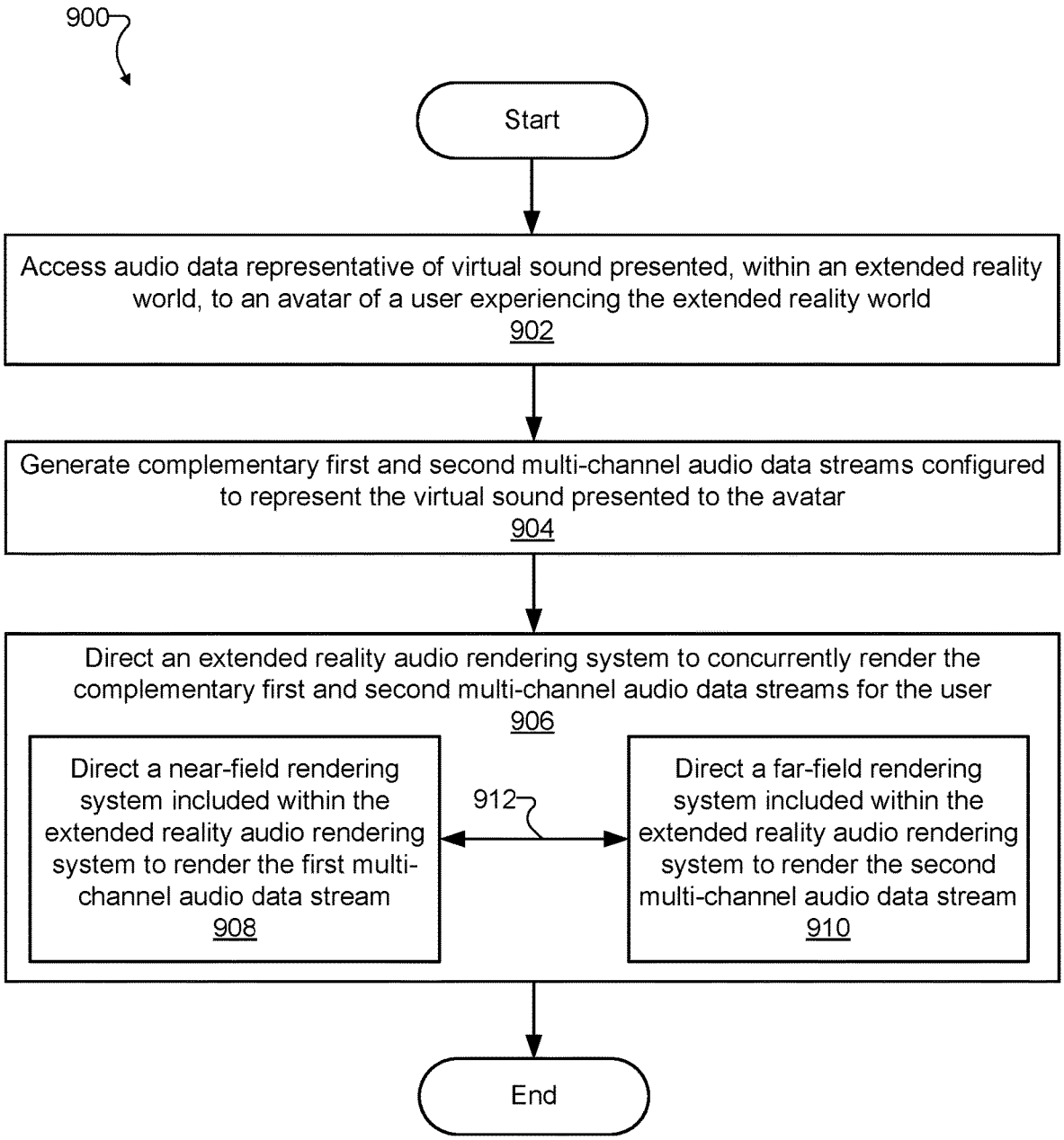
FIG. 9 illustrates an exemplary extended reality audio processing method for near-field and far-field audio reproduction according to principles described herein.

FIG. 9 illustrates an exemplary extended reality audio processing method 900 for near-field and far-field audio reproduction. While FIG. 9 illustrates exemplary operations according to one embodiment, other embodiments may omit, add to, reorder, and/or modify any of the operations shown in FIG. 9. One or more of the operations shown in FIG. 9 may be performed by audio system 200, any components included therein, and/or any implementation thereof. For example, one or more of the operations shown in FIG. 9 may be performed by processing system 202 within audio system 200 as processing system 202 interoperates with rendering system 204.

In operation 902, an extended reality audio processing system may access audio data. For example, the audio data may be representative of virtual sound presented, within an extended reality world, to an avatar of a user experiencing the extended reality world. Operation 902 may be performed in any of the ways described herein.

In operation 904, the extended reality audio processing system may generate complementary first and second multi-channel audio data streams. For example, the complementary first and second multi-channel audio data streams may be generated based on the audio data accessed in operation 902. In combination, the complementary first and second multi-channel audio data streams may be configured to represent the virtual sound presented to the avatar. Operation 904 may be performed in any of the ways described herein.

In operation 906, the extended reality audio processing system may direct an extended reality audio rendering system to concurrently render the complementary first and second multi-channel audio data streams for the user. Operation 906 may be performed in any of the ways described herein. For example, as shown, operation 906 may be performed by performing operations 908 and 910, which, as indicated by arrow 912, may be performed concurrently with one another.

In operation 908, the extended reality audio processing system may direct a near-field rendering system to render the first multi-channel audio data stream. The near-field rendering system may be included, for instance, within the extended reality audio rendering system with which the extended reality audio processing system interoperates. Operation 908 may be performed in any of the ways described herein.

In operation 910, the extended reality audio processing system may direct a far-field rendering system to render the second multi-channel audio data stream. The far-field rendering system may also be included, in certain examples, within the extended reality audio rendering system with which the extended reality audio processing system interoperates. Operation 910 may be performed in any of the ways described herein.

Figure 10:
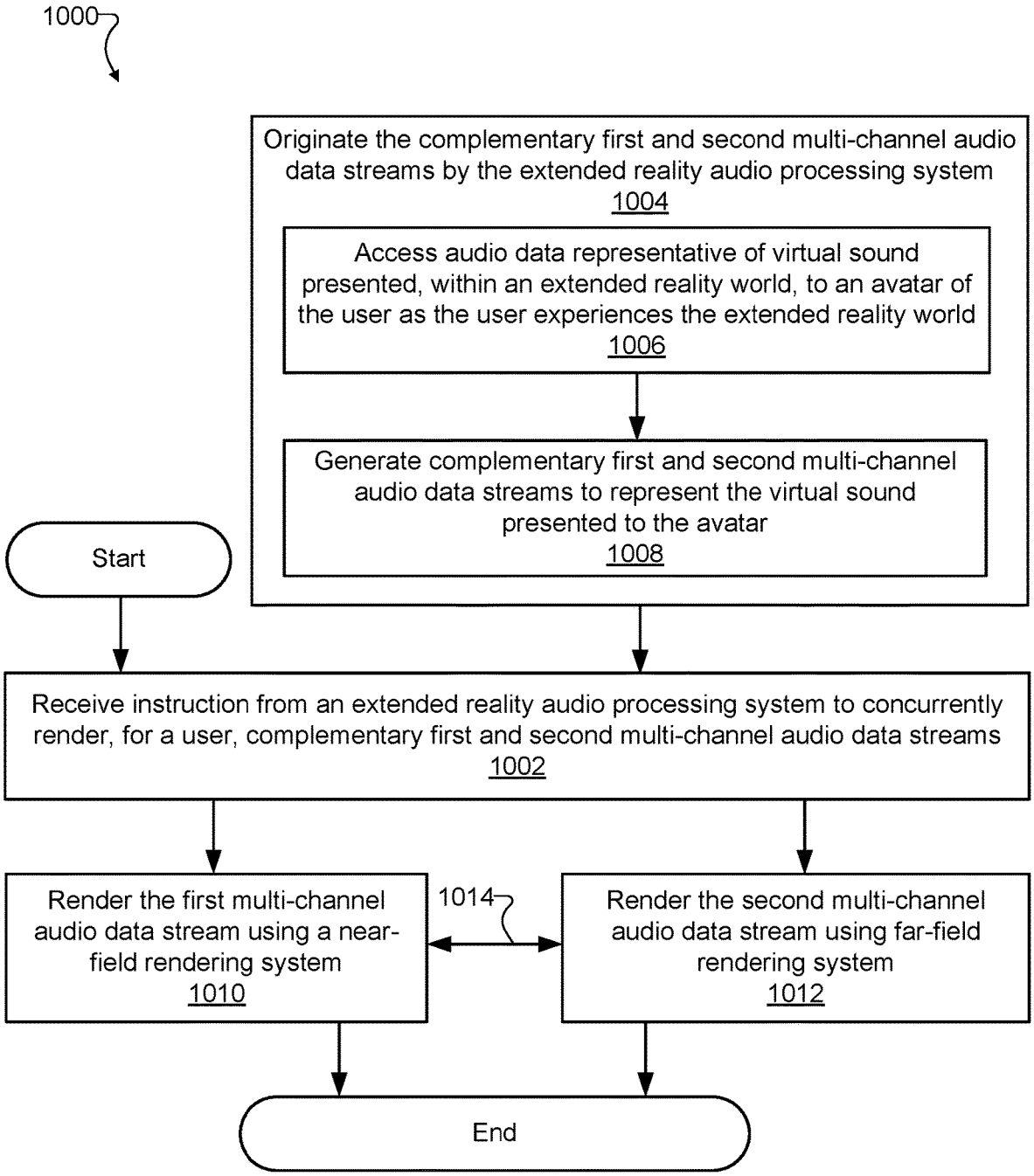
FIG. 10 illustrates an exemplary extended reality audio rendering method for near-field and far-field audio reproduction according to principles described herein.

FIG. 10 illustrates an exemplary extended reality audio rendering method 1000 for near-field and far-field audio reproduction. While FIG. 10 illustrates exemplary operations according to one embodiment, other embodiments may omit, add to, reorder, and/or modify any of the operations shown in FIG. 10. One or more of the operations shown in FIG. 10 may be performed by audio system 200, any components included therein, and/or any implementation thereof. For example, one or more of the operations shown in FIG. 10 may be performed by rendering system 204 within audio system 200 as rendering system 204 interoperates with processing system 202.

In operation 1002, an extended reality audio rendering system may receive instruction from an extended reality audio processing system with which the extended reality audio rendering system interoperates. For example, the instruction received in operation 1002 may be an instruction to concurrently render complementary first and second multi-channel audio data streams for a user.

In operation 1004, the extended reality audio processing system interoperating with the extended reality audio rendering system may originate the complementary first and second multi-channel audio data streams. Accordingly, as shown in operation 1004, the complementary first and second multi-channel audio data streams represented by the instruction received in operation 1002 may be originated in any of the ways described herein. For example, the originating of the complementary first and second multi-channel audio data streams by the extended reality audio processing system may be performed by performing operations 1006 and 1008, which are sub-operations of operation 1004 and may also be performed in any of the ways described herein. In operation 1006, the extended reality audio processing system interoperating with the extended reality audio rendering system may access audio data representative of virtual sound presented, within an extended reality world, to an avatar of the user as the user experiences the extended reality world. In operation 1008, the extended reality audio processing system interoperating with the extended reality audio rendering system may generate, based on the audio data, the complementary first and second multi-channel audio data streams to represent, in combination, the virtual sound presented to the avatar.

In operation 1010, the extended reality audio rendering system may render the first multi-channel audio data stream originated by the extended reality audio processing system in operation 1004 and received as part of the instruction in operation 1002. For example, the first multi-channel audio data stream may be rendered by a near-field rendering system included within the extended reality audio rendering system based on the instruction received in operation 1002 from the extended reality audio processing system.

Similarly, in operation 1012, the extended reality audio rendering system may render the second multi-channel audio data stream originated by the extended reality audio processing system in operation 1004 and received as part of the instruction in operation 1002. For example, the second multi-channel audio data stream may be rendered by a far-field rendering system included within the extended reality audio rendering system based on the instruction received in operation 1002 from the extended reality audio processing system.

Operations 1010 and 1012 may be performed in any of the ways described herein. For example, as illustrated by an arrow 1014 in FIG. 10, operations 1010 and 1012 may be performed concurrently so that both the first and second multi-channel audio data streams are rendered for the user at the same time.

In some examples, a non-transitory computer-readable medium storing computer-readable instructions may be provided in accordance with the principles described herein. The instructions, when executed by a processor of a computing device, may direct the processor and/or computing device to perform one or more operations, including one or more of the operations described herein. Such instructions may be stored and/or transmitted using any of a variety of known computer-readable media.

A non-transitory computer-readable medium as referred to herein may include any non-transitory storage medium that participates in providing data (e.g., instructions) that may be read and/or executed by a computing device (e.g., by a processor of a computing device). For example, a non-transitory computer-readable medium may include, but is not limited to, any combination of non-volatile storage media and/or volatile storage media. Exemplary non-volatile storage media include, but are not limited to, read-only memory, flash memory, a solid-state drive, a magnetic storage device (e.g. a hard disk, a floppy disk, magnetic tape, etc.), ferroelectric random-access memory ("RAM"), and an optical disc (e.g., a compact disc, a digital video disc, a Blu-ray disc, etc.). Exemplary volatile storage media include, but are not limited to, RAM (e.g., dynamic RAM).

Figure 11:
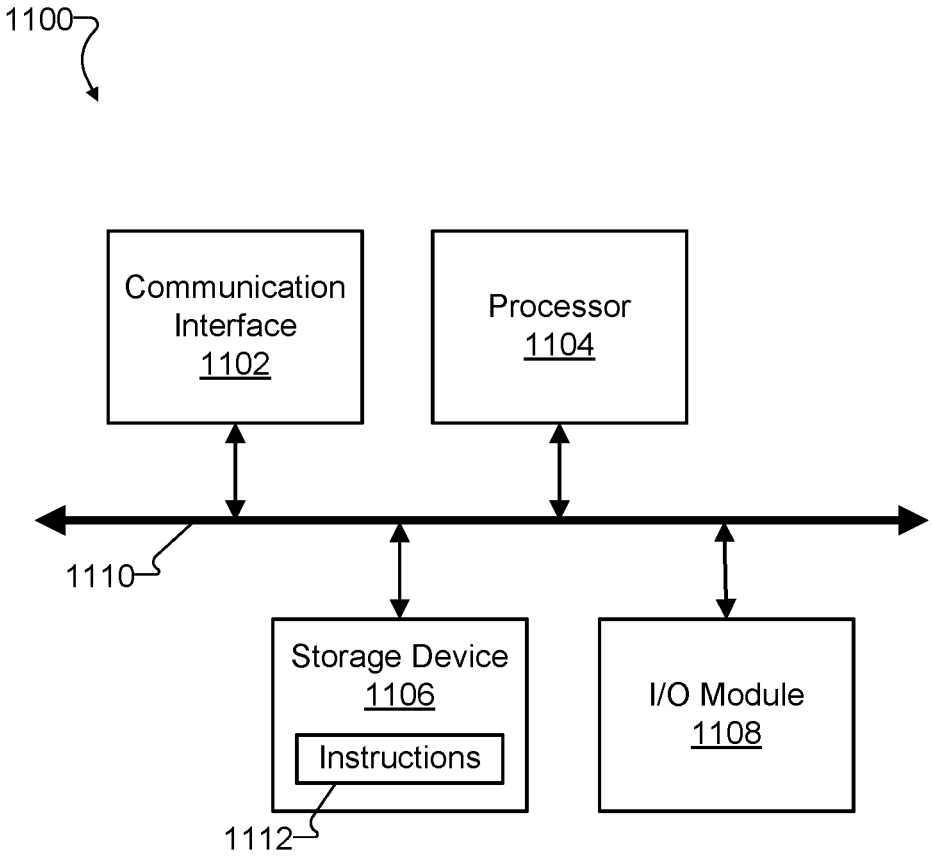
FIG. 11 illustrates an exemplary computing device according to principles described herein.

FIG. 11 illustrates an exemplary computing device 1100 that may be specifically configured to perform one or more of the processes described herein. As shown in FIG. 11, computing device 1100 may include a communication interface 1102, a processor 1104, a storage device 1106, and an input/output ("I/O") module 1108 communicatively connected one to another via a communication infrastructure 1110. While an exemplary computing device 1100 is shown in FIG. 11, the components illustrated in FIG. 11 are not intended to be limiting. Additional or alternative components may be used in other embodiments. Components of computing device 1100 shown in FIG. 11 will now be described in additional detail.

Communication interface 1102 may be configured to communicate with one or more computing devices. Examples of communication interface 1102 include, without limitation, a wired network interface (such as a network interface card), a wireless network interface (such as a wireless network interface card), a modem, an audio/video connection, and any other suitable interface.

Processor 1104 generally represents any type or form of processing unit capable of processing data and/or interpreting, executing, and/or directing execution of one or more of the instructions, processes, and/or operations described herein. Processor 1104 may perform operations by executing computer-executable instructions 1112 (e.g., an application, software, code, and/or other executable data instance) stored in storage device 1106.

Storage device 1106 may include one or more data storage media, devices, or configurations and may employ any type, form, and combination of data storage media and/or device. For example, storage device 1106 may include, but is not limited to, any combination of the non-volatile media and/or volatile media described herein. Electronic data, including data described herein, may be temporarily and/or permanently stored in storage device 1106. For example, data representative of computer-executable instructions 1112 configured to direct processor 1104 to perform any of the operations described herein may be stored within storage device 1106. In some examples, data may be arranged in one or more databases residing within storage device 1106.

I/O module 1108 may include one or more I/O modules configured to receive user input and provide user output. I/O module 1108 may include any hardware, firmware, software, or combination thereof supportive of input and output capabilities. For example, I/O module 1108 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1108 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1108 is configured to provide graphical data to a display for presentation to a user. The graphical data may be representative of one or more graphical user interfaces and/or any other graphical content as may serve a particular implementation.

In some examples, any of the systems, computing devices, and/or other components described herein may be implemented by computing device 1100. For example, storage facility 206 of audio processing system 202 and/or storage facility 212 of audio rendering system 204 may be implemented by storage device 1106. Likewise, and processing facility 208 of audio processing system 202 and/or processing facility 214 of audio rendering system 204 may be implemented by processor 1104.

To the extent the aforementioned embodiments collect, store, and/or employ personal information provided by individuals, it should be understood that such information shall be used in accordance with all applicable laws concerning protection of personal information. Additionally, the collection, storage, and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

accessing, by an extended reality audio processing system implemented by a mobile edge compute ("MEC") server, audio data representative of virtual sound presented, within an extended reality world, to an avatar of a user experiencing the extended reality world;

generating, by the extended reality audio processing system based on the audio data, complementary first and second multi-channel audio data streams configured, in combination, to represent the virtual sound presented to the avatar; and directing, by the extended reality audio processing system, an extended reality audio rendering system to concurrently render, for the user, the complementary first and second multi-channel audio data streams, wherein the extended reality audio rendering system is implemented by a media player device separate from the MEC server implementing the extended reality audio processing system and the directing includes:

directing a near-field rendering system included within the extended reality audio rendering system to render the first multi-channel audio data stream, and directing a far-field rendering system included within the extended reality audio rendering system to render the second multi-channel audio data stream.

2. The method of claim 1, wherein:

the audio data representative of the virtual sound includes audio data from a set of distinct sound sources; and the generating of the complementary first and second multi-channel audio data streams comprises generating the first multi-channel audio data stream based on audio data from a first subset of the set of distinct sound sources, and generating the second multi-channel audio data stream based on audio data from a second subset of the set of distinct sound sources, the second subset different from the first subset.

3. The method of claim 1, wherein:

the audio data representative of the virtual sound includes audio data representative of a first component of the virtual sound within a first frequency range, and audio data representative of a second component of the virtual sound within a second frequency range distinct from the first frequency range; and the generating of the complementary first and second multi-channel audio data streams comprises generating the first multi-channel audio data stream based on the audio data representative of the first component, and generating the second multi-channel audio data stream based on the audio data representative of the second component.

4. The method of claim 1, wherein:

the accessed audio data is encoded in a single multi-channel audio data stream that represents the virtual sound presented to the avatar; and the generating of the complementary first and second multi-channel audio data streams is performed by converting the single multi-channel audio data stream into the complementary first and second multi-channel audio data streams.

5. The method of claim 1, wherein:

the first multi-channel audio data stream represents a first component of the virtual sound that is not represented by the second multi-channel audio data stream;

the second multi-channel audio data stream represents a second component of the virtual sound that is not represented by the first multi-channel audio data stream; and the first and second components of the virtual sound are presented concurrently to the avatar.

6. The method of claim 1, further comprising accessing, by the extended reality audio processing system as the virtual sound propagates to the avatar within the extended reality world, head pose data dynamically representing a current position and orientation of a head of the avatar in relation to a virtual sound source in the extended reality world;

wherein the generating of the complementary first and second multi-channel audio data streams comprises accounting for the head pose data in the generating of the first multi-channel audio data stream based on the audio data, and abstaining from accounting for the head pose data in the generating of the second multi-channel audio data stream based on the audio data.

7. The method of claim 1, embodied as computer-executable instructions on at least one non-transitory computer-readable medium.

8. A method comprising:

receiving, by an extended reality audio rendering system implemented by a media player device used by a user, instruction from an extended reality audio processing system to concurrently render, for the user, complementary first and second multi-channel audio data streams, wherein the extended reality audio processing system is implemented by a mobile edge compute ("MEC") server separate from the media player device implementing the extended reality audio rendering system and the complementary first and second multi-channel audio data streams are originated by the extended reality audio processing system by:

accessing audio data representative of virtual sound presented, within an extended reality world, to an avatar of the user as the user experiences the extended reality world, and generating, based on the audio data, the complementary first and second multi-channel audio data streams to represent, in combination, the virtual sound presented to the avatar;

rendering, by a near-field rendering system included within the extended reality audio rendering system and based on the instruction received from the extended reality audio processing system, the first multi-channel audio data stream; and rendering, by a far-field rendering system included within the extended reality audio rendering system and based on the instruction received from the extended reality audio processing system, the second multi-channel audio data stream concurrently with the rendering of the first multi-channel audio data stream.

9. The method of claim 8, wherein:

the audio data representative of the virtual sound includes audio data from a set of distinct sound sources;

the rendering of the first multi-channel audio data stream by the near-field rendering system includes rendering sound that originates from a first subset of the set of distinct sound sources; and the rendering of the second multi-channel audio data stream by the far-field rendering system includes rendering sound that originates from a second subset of the set of distinct sound sources, the second subset different from the first subset.

10. The method of claim 8, wherein:

the audio data representative of the virtual sound includes audio data representative of a first component of the virtual sound within a first frequency range, and audio data representative of a second component of the virtual sound within a second frequency range distinct from the first frequency range;

the rendering of the first multi-channel audio data stream by the near-field rendering system includes rendering the first component of the virtual sound; and the rendering of the second multi-channel audio data stream by the far-field rendering system includes rendering the second component of the virtual sound.

11. The method of claim 8, wherein:

the first multi-channel audio data stream represents a first component of the virtual sound that is not represented by the second multi-channel audio data stream;

the second multi-channel audio data stream represents a second component of the virtual sound that is not represented by the first multi-channel audio data stream; and the first and second components of the virtual sound are presented concurrently to the avatar.

12. The method of claim 8, wherein:

the complementary first and second multi-channel audio data streams are further originated by the extended reality audio processing system by accessing, as the virtual sound propagates to the avatar within the extended reality world, head pose data dynamically representing a current position and orientation of a head of the avatar in relation to a virtual sound source in the extended reality world;

the first multi-channel audio data stream rendered by the near-field rendering system accounts for the head pose data; and the second multi-channel audio data stream rendered by the far-field rendering system abstains from accounting for the head pose data.

13. The method of claim 8, wherein:

the near-field rendering system includes stereo headphones worn by the user as the user experiences the extended reality world;

the far-field rendering system includes an array of loudspeakers positioned at locations on a border encompassing the user as the user experiences the extended reality world;

the rendering of the first multi-channel audio data stream includes reproducing, by the stereo headphones, a component of the virtual sound represented by the first multi-channel audio data stream; and the rendering of the second multi-channel audio data stream includes reproducing, by the array of loudspeakers, a component of the virtual sound represented by the second multi-channel audio data stream.

14. The method of claim 8, embodied as computer-executable instructions on at least one non-transitory computer-readable medium.

15. An extended reality audio processing system implemented by a mobile edge compute ("MEC") server and comprising:

a memory storing instructions; and a processor communicatively coupled to the memory and configured to execute the instructions to:

access audio data representative of virtual sound presented, within an extended reality world, to an avatar of a user experiencing the extended reality world, generate, based on the audio data, complementary first and second multi-channel audio data streams configured, in combination, to represent the virtual sound presented to the avatar, and direct an extended reality audio rendering system to concurrently render, for the user, the complementary first and second multi-channel audio data streams, wherein the extended reality audio rendering system is implemented by a media player device separate from the MEC server implementing the extended reality audio processing system and the directing includes:

directing a near-field rendering system included within the extended reality audio rendering system to render the first multi-channel audio data stream, and directing a far-field rendering system included within the extended reality audio rendering system to render the second multi-channel audio data stream.

16. The extended reality audio processing system of claim 15, wherein:

the audio data representative of the virtual sound includes audio data from a set of distinct sound sources; and the generating of the complementary first and second multi-channel audio data streams comprises generating the first multi-channel audio data stream based on audio data from a first subset of the set of distinct sound sources, and generating the second multi-channel audio data stream based on audio data from a second subset of the set of distinct sound sources, the second subset different from the first subset.

17. The extended reality audio processing system of claim 15, wherein:

the audio data representative of the virtual sound includes audio data representative of a first component of the virtual sound within a first frequency range, and audio data representative of a second component of the virtual sound within a second frequency range distinct from the first frequency range; and the generating of the complementary first and second multi-channel audio data streams comprises generating the first multi-channel audio data stream based on the audio data representative of the first component, and generating the second multi-channel audio data stream based on the audio data representative of the second component.

18. An extended reality audio rendering system implemented by a media player device used by a user and comprising:

a near-field rendering system;

a far-field rendering system;

a memory storing instructions; and a processor communicatively coupled to the memory and configured to execute the instructions to:

receive instruction from an extended reality audio processing system to concurrently render, for a user, complementary first and second multi-channel audio data streams, wherein the extended reality audio processing system is implemented by a mobile edge compute ("MEC") server separate from the media player device implementing the extended reality audio rendering system and the complementary first and second multi-channel audio data streams are originated by the extended reality audio processing system by:

accessing audio data representative of virtual sound presented, within an extended reality world, to an avatar of the user as the user experiences the extended reality world, and generating, based on the audio data, the complementary first and second multi-channel audio data streams to represent, in combination, the virtual sound presented to the avatar;

render, by the near-field rendering system based on the instruction received from the extended reality audio processing system, the first multi-channel audio data stream; and render, by the far-field rendering system based on the instruction received from the extended reality audio processing system, the second multi-channel audio data stream concurrently with the rendering of the first multi-channel audio data stream.

19. The extended reality audio rendering system of claim 18, wherein:

the audio data representative of the virtual sound includes audio data from a set of distinct sound sources;

the rendering of the first multi-channel audio data stream by the near-field rendering system includes rendering sound that originates from a first subset of the set of distinct sound sources; and the rendering of the second multi-channel audio data stream by the far-field rendering system includes rendering sound that originates from a second subset of the set of distinct sound sources, the second subset different from the first subset.

20. The extended reality audio rendering system of claim 18, wherein:

the audio data representative of the virtual sound includes audio data representative of a first component of the virtual sound within a first frequency range, and audio data representative of a second component of the virtual sound within a second frequency range distinct from the first frequency range;

the rendering of the first multi-channel audio data stream by the near-field rendering system includes rendering the first component of the virtual sound; and the rendering of the second multi-channel audio data stream by the far-field rendering system includes rendering the second component of the virtual sound.

* * * * *